US009441831B2

(12) United States Patent
Fossen et al.

(10) Patent No.: US 9,441,831 B2
(45) Date of Patent: Sep. 13, 2016

(54) LAMINAR WATER FOUNTAIN

(71) Applicant: Custom Molded Products, Inc., Newnan, GA (US)

(72) Inventors: Jens Fossen, Atlanta, GA (US); Jesse Leech, Newnan, GA (US)

(73) Assignee: Custom Molded Products, Inc., Newnan, GA (US)

( * ) Notice: Subject to any disclaimer, the term of this patent is extended or adjusted under 35 U.S.C. 154(b) by 60 days.

(21) Appl. No.: 14/530,701

(22) Filed: Nov. 1, 2014

(65) Prior Publication Data

US 2016/0121357 A1 May 5, 2016

(51) Int. Cl.

| | |
|---|---|
| ***B05B 17/08*** | (2006.01) |
| ***E03B 9/20*** | (2006.01) |
| ***F21V 33/00*** | (2006.01) |
| *F21W 121/02* | (2006.01) |
| *F21Y 101/02* | (2006.01) |

(52) U.S. Cl.

CPC ..... *F21V 33/006* (2013.01); *B05B 17/08* (2013.01); *F21W 2121/02* (2013.01); *F21Y 2101/02* (2013.01)

(58) Field of Classification Search

CPC ..... B05B 1/044; B05B 17/085; B05B 17/08; B05B 1/36; E04H 4/148

USPC ..... 239/16, 17

See application file for complete search history.

(56) References Cited

U.S. PATENT DOCUMENTS

| | | | | |
|---|---|---|---|---|
| 3,858,620 | A * | 1/1975 | Hruby, Jr. | B05B 17/08 239/17 |
| 4,889,283 | A * | 12/1989 | Fuller | B05B 1/10 239/11 |
| 5,934,558 | A * | 8/1999 | Samayoa | B05B 7/0416 137/512.1 |
| 8,042,748 | B2 * | 10/2011 | Hagaman | B05B 1/3013 239/17 |
| 8,177,141 | B2 * | 5/2012 | Hagaman | B05B 1/3013 239/17 |
| 2010/0237167 | A1 * | 9/2010 | Ficyk | B05B 17/08 239/17 |

* cited by examiner

*Primary Examiner* — Davis Hwu

(74) *Attorney, Agent, or Firm* — Laurence P. Colton; Smith Tempel Blaha LLC

(57) ABSTRACT

A laminar water fountain device having a canister housing, a housing lid, and an adjustable jet body suspended in the canister housing for producing the water fountain. The canister housing has an inlet end through which water is supplied to the jet body and an outlet end through which the jet body ejects the water fountain. The jet body has tangentially mounted inlet ports and internal filter elements to help maintain a less turbulent water flow through the jet body, so as to help result in a laminar water fountain. The jet body is at least partially adjustable in the canister housing such that the angle of the water fountain emanating from the water fountain device is adjustable.

29 Claims, 17 Drawing Sheets

LAMINAR WATER FOUNTAIN

BACKGROUND OF THE INVENTION

1. Technical Field

The present disclosure relates generally to water features for pools, spas, hot tubs, baths, and fountains (all together referred to as a water body or water bodies), and more specifically to adjustable laminar fountains for providing aesthetic water fountains to such water bodies.

2. Prior Art

Water features such as water jet devices, water fountain devices, and waterfall producing devices, are used in ornamental and utilitarian pools, spas, hot tubs, baths, and fountains to provide aesthetics to such water bodies. Water fountain devices are used to create a spout of water that travels up in the air a certain distance, usually in an arc. Such water fountain devices may utilize a system to force water under high pressure to achieve a desired vertical height, which then falls into the water feature in an ornamental arc. Water fountain devices can be situated at an angle so as to create and control the arc of the water flowing out of the jet. The height and angle of the water stream emanating from the water fountain device can be manipulated by adjusting the volume of the water supply via a valve and by adjusting the angular flow of the water supply via a nozzle. The water stream then is directed through an outlet of the device toward the water receptacle to create the water fountain.

Often, the water fountain contains air bubbles and/or emanates from the water fountain devices in a turbulent flow. Various water fountain devices are known in the prior art. For example, it is well-known to provide a water fountain device or water jet device for sending an arcing stream of water into a water receptacle. Such an arcing stream can be, for example, for functional purposes, such as for filling the water receptacle, or for aesthetic purposes, such as an ornamental arc of water, or for both. While streams of water containing bubbles and/or having a turbulent flow can be desired by some users and in some circumstances, it often is preferable to reduce or eliminate the presence of air bubbles in the water fountain and to produce the water fountain with a laminar flow of water.

Current products use metal screens to baffle the water flow and remove turbulence. These are very difficult to service and frequently get clogged with debris which affects the laminarity of the stream. Also, current products use a single inlet elbow fitting Accordingly, there is a need for a water fountain device that produces a water fountain having a laminar flow. It is to this need and others that the present invention is directed.

BRIEF SUMMARY OF THE INVENTION

The presently disclosed embodiments, as well as features and aspects thereof, are directed towards a water fountain device comprising a substantially cylindrical canister housing, a housing lid, and an adjustable jet body for producing the water fountain. The canister housing comprises an inlet end, preferably a lower end, through which water is supplied to the jet body and an outlet end, preferably an upper end, through which the jet body ejects the water fountain. The jet body preferably is at least partially adjustable in the canister housing such that the angle of the water fountain emanating from the water fountain device is adjustable.

The canister housing defines a substantially cylindrical internal side wall surface extending upwards from a bottom wall, an open top so as to form a cup-like structure, and a hollow interior. The side wall preferably has at least one water inlet, although the water inlet can be on the bottom wall. The bottom wall has at least one wiring inlet/drain combination, although the wiring inlet/drain combination can be on the side wall and/or the wiring inlet and drain can be separate features or openings. The water inlet can comprise a water flow splitter, either as part of the water inlet or a separate structure that cooperates with the water inlet, configured to split the flow of the incoming water into at least two flows of water that are provided to the jet body. Flexible tubes, such as rubber or silicon, connect the splitter to the jet body. The canister housing is not limited to cylinders, and can be any shape.

The housing lid defines a substantially circular structure that fits over, on, or within the open top of the canister housing, and comprises a water fountain port and jet body supports. The water fountain port preferably is a radial port through the housing lid, extending from approximately, or proximal to, the center of the housing lid to approximately, or proximal to, the circumference of the housing lid. Alternatively, the water fountain port can be along a diameter of the housing lid having ends proximal to the circumference of the housing lid. The water fountain port allows the water fountain ejected from the jet body to leave the canister housing. Preferably two jet body supports depend downward from the bottom (interior) surface of the housing lid into the canister housing for holding the jet body in an adjustable manner. The housing lid is not limited to circular, and can be any shape that cooperates with the open top of the canister housing.

The jet body defines a substantially cylindrical structure having a cylindrical side wall, a top wall, a bottom wall, and a hollow interior. The jet body also can have a funnel-shaped portion between the side wall and the bottom wall, the bottom wall having a smaller diameter than the side wall. The top wall comprises a nozzle for producing the water fountain. The side wall comprises at least one connection structure for connecting the jet body to the jet body supports of the housing lid. The funnel-shaped portion, or the side wall, comprises at least one water inlet for receiving a flow of water from the water inlet of the canister housing, or the water flow splitter. For example, the flexible tubes can connect the water inlet of the canister housing, or the water flow splitter, to the at least one inlet port of the jet body. The bottom wall comprises an opening allowing access to the hollow interior of the jet body.

Within the hollow interior of the jet body there can be filter elements for filtering the water flow, lighting elements for lighting the water flow, and/or directional walls for directing the water flow through the jet body. A filter element or elements can be used to promote laminar flow of the water flow through the hollow interior of the jet body and to mechanically filter debris from the water flow. Lighting elements can light the water flow so as to produce a lighted water fountain emanating from the water fountain device for aesthetic purposes. A directional wall can extend upwards from the opening in the bottom wall a certain height within the hollow interior of the jet body, and having a diameter smaller than the diameter of the side wall of the jet body, thereby forming an annular region with the side wall, the annular region preferably bound by the directional wall and the funnel-shaped portion and opening upwards towards the top wall. The filter elements can be at least partially supported by the directional wall, leaving the annular region open.

The at least one water inlet to the jet body preferably is located on the funnel shaped portion, or on the lower end of the side wall of the jet body, whereby the water flow is directed into the lower portion of the hollow interior of the jet body, preferably into the annular region. The at least one water inlet preferably is mounted so as to provide a tangential flow into the jet body so as to allow more lateral fluid and pressure distribution of the water into the jet body. In this manner, the water flow into the jet body is directed circumferentially around the outer surface of the inner wall of the cylindrical side wall, or circumferentially within the annular region. As the annular region fills, or is filled, the water flow is forced upwards into the main portion of the hollow interior, preferably through the filter element, and then out of the nozzle in the top wall. A hollow region can be left between the top filter element, or the top of the filter element, and the top wall to serve as a manifold region for the water flow.

A lighting structure can be inserted through the opening in the bottom wall into the hollow interior of the jet body. The lighting structure can be supported by the directional wall and/or a closing structure for the opening. The lighting structure expends at least partway upwards within the hollow interior of the jet body whereby the light can be directed into the water flow and/or the water in manifold region and then out of the jet body through the nozzle so as provide for a lighted water fountain. When using a lighting structure and a filter element, the filter element must have a hollow central core region, namely an annular filter element, whereby the lighting structure and fit within the hollow core so as to provide unblocked light to the water flow and/or the water in the manifold region.

A complete understanding of the present invention may be obtained by reference to the accompanying drawings, when considered in conjunction with the detailed description of preferred embodiments, in which like elements and components bear the same designations and numbering throughout the figures.

BRIEF DESCRIPTION OF THE DRAWING

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Figure 1:
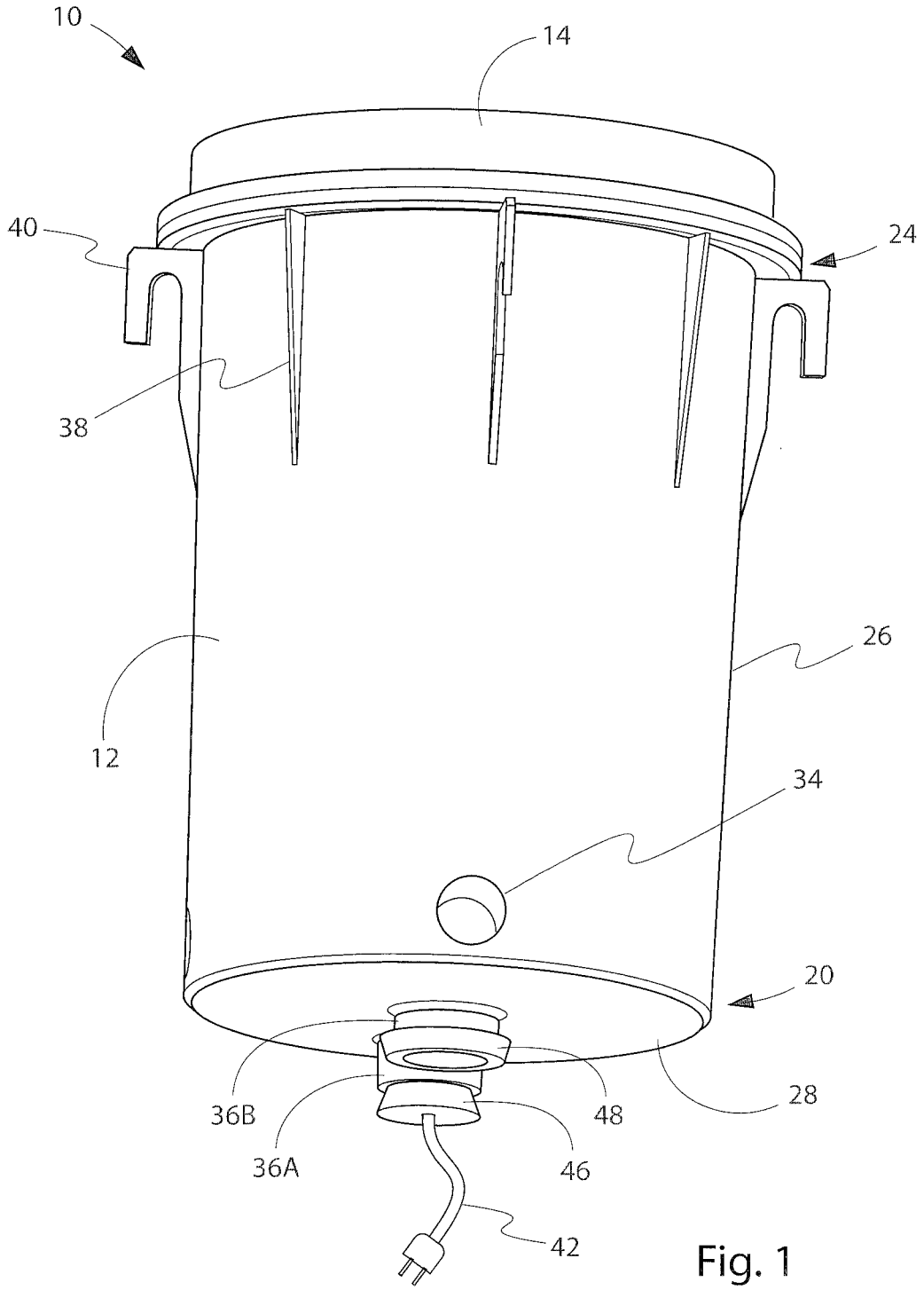
FIG. 1 is a side perspective view of the canister housing.

Aspects, features and advantages of several exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Any aspect described herein as "exemplary" is not necessarily to be construed as exclusive, preferred or advantageous over other aspects.

Referring to the figures, the presently disclosed embodiments, as well as features and aspects thereof, are directed towards a water fountain device 10 comprising a substantially cylindrical canister housing 12, a housing lid 14, and an adjustable jet body 16 for producing the water fountain 18. The canister housing 12 comprises an inlet end 20, preferably a lower end, through which water 22 is supplied to the jet body 16 and an outlet end 24, preferably an upper end, through which the jet body 16 ejects the water fountain 18. The jet body 16 preferably is at least partially adjustable in the canister housing 12 such that the angle of the water fountain 18 emanating from the water fountain device 10 is adjustable. The water fountain 18 created by the device 10 is a rod-like stream of water that is meant to be streamed into a water body.

FIG. 1 shows an exemplary side perspective view of the canister housing 12. The canister housing 12 defines a substantially cylindrical side wall 26 extending upwards from a bottom wall 28, an open top 30 so as to form a cup-like or bucket-like structure, and a hollow interior 32. The side wall 26 preferably has at least one water inlet 34, although the water inlet 34 can be on the bottom wall 28. The bottom wall 28 has at least one wiring inlet/drain combination 36, although the wiring inlet/drain combination 36 can be on the side wall 26 and/or the wiring inlet 36A and the drain 36B can be separate features or openings. The canister housing 12 is not limited to cylinders, and can be any shape. Housing lid 14 fits on the top off housing canister 12 so as to at least partially cover or close the open top 30. Spacing ribs 38 on the outer side of the side wall 26 allow for the housing canister 12 to be maintained centrally within a mounting hole for the device 10, such as a hole in the cement floor of the water body. Hooks 40 on the outer side of the side wall 26 allow for the housing canister 12 to be suspended on cooperating supports of hangers within such a mounting hole or on a support structure for holding the device 10.

Figure 2:
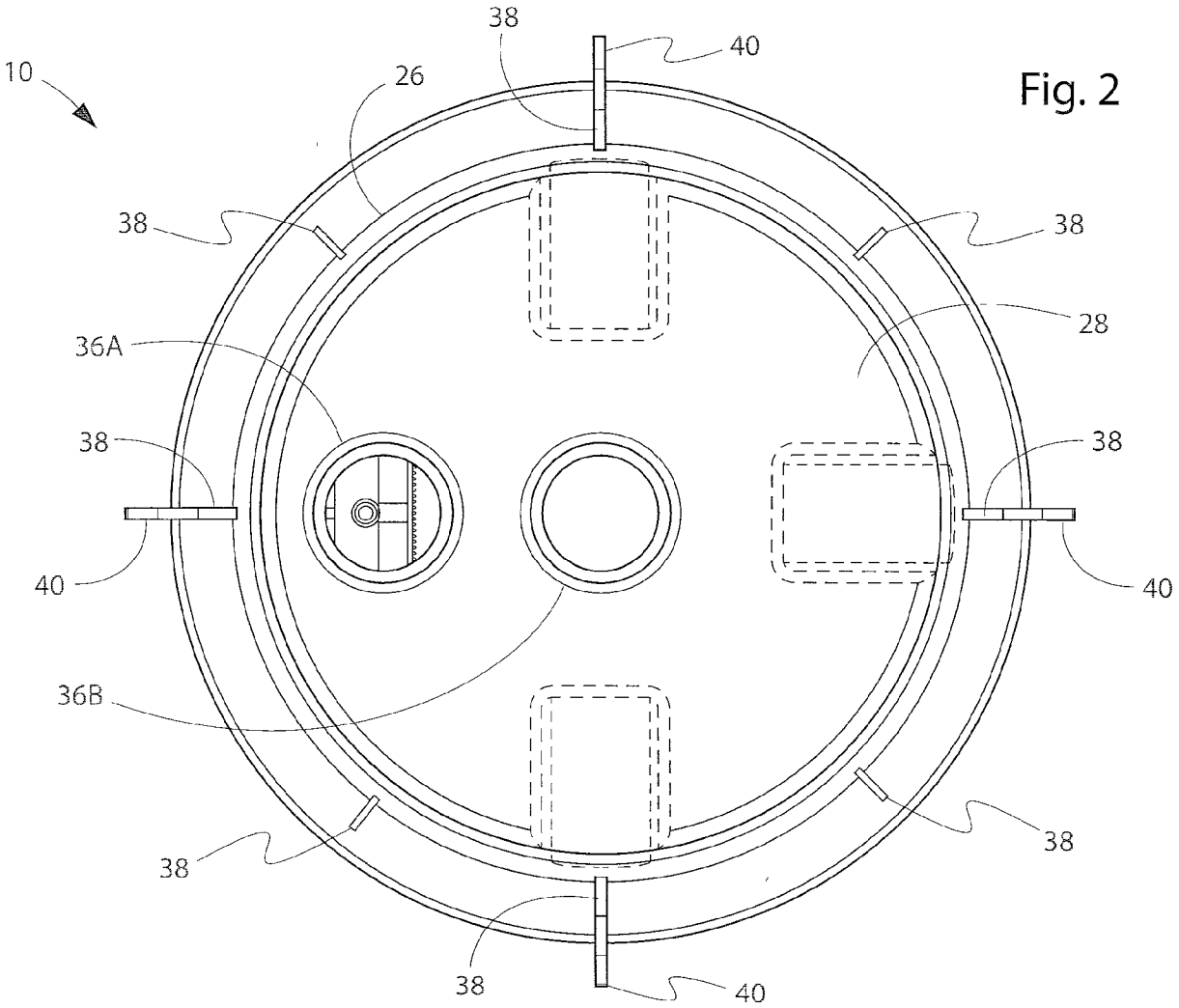
FIG. 2 is a bottom view of the canister housing.

FIG. 2 shows an exemplary bottom view of the canister housing 12 showing exemplary embodiments of the wiring inlet/drain combination 36. Two wiring inlet/drain combinations 36 are shown, one of which can be used for electrical wiring 42 for supplying electricity to, for example, the light 44, and the other of which can be used as a drain for any water collecting in the housing canister 12. For example, it may be advantageous to run the wiring 42 through the central wiring inlet 36A and to maintain, support, or secure the wiring 42 with a plug 46, and therefore to have a separate wiring inlet 36A. In this embodiment, drain 36B would be a separate opening, which could be capped with a cap 48 if desired. Eight spacing ribs 38 are shown, four of which are separate and four of which are integrated with hooks 40. Preferably, the spacing ribs 38 and the hooks 40 are evenly spaced about the circumference of the canister housing 12.

Figure 3:
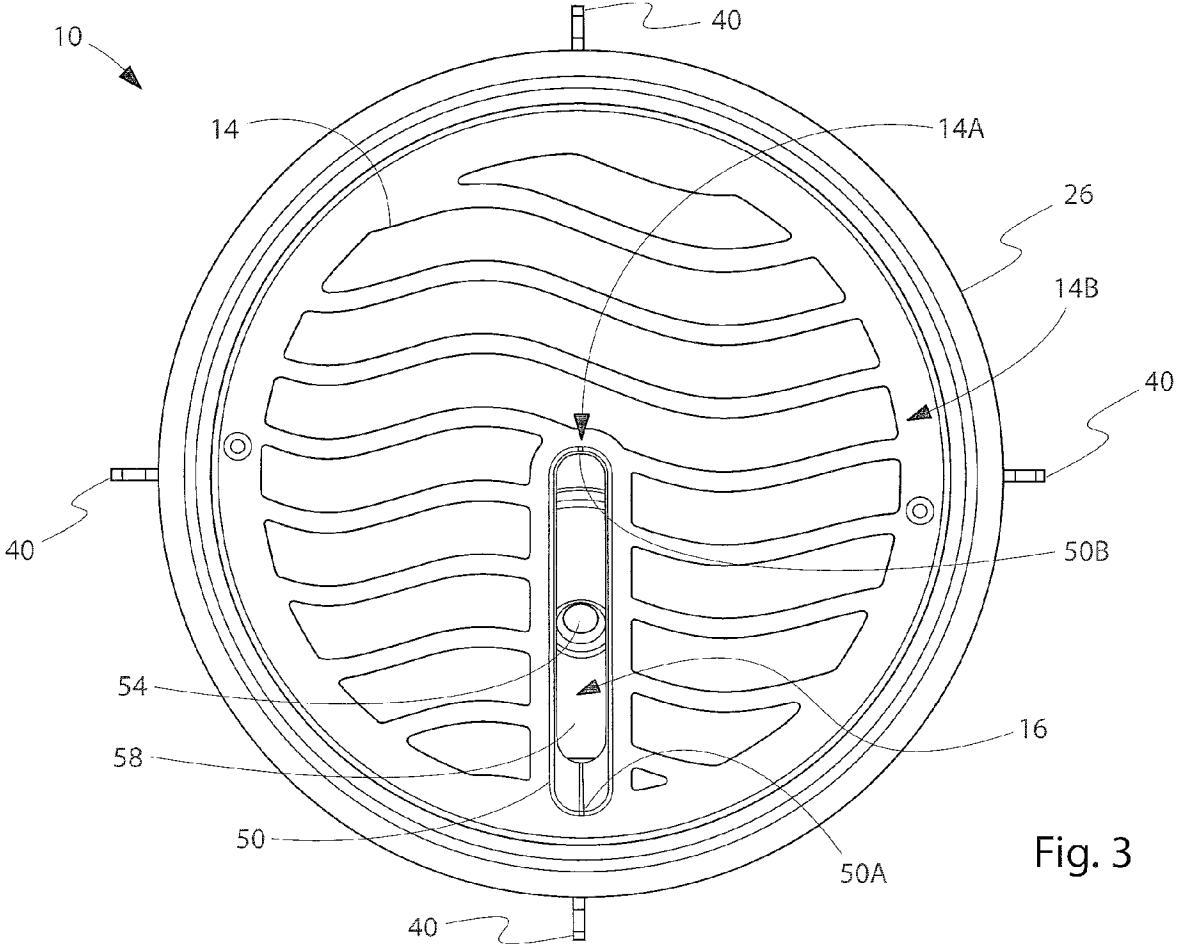
FIG. 3 is a top view of the canister housing showing the canister lid.

FIG. 3 shows an exemplary top view of the canister housing 12 showing the housing lid 14. The housing lid 14 defines a substantially circular structure that fits over, on, or within the open top 30 of the canister housing 12, and comprises a water fountain port 50 and jet body supports 52. The water fountain port 50 preferably is a radial port through the housing lid 14, extending from approximately, or proximal to, the center of the housing lid 14A to approximately, or proximal to, the circumference of the housing lid 14B. Alternatively, the water fountain port 50 can be along a diameter of the housing lid 14 having ends proximal to the circumference of the housing lid 14B. The water fountain port 50 allows the water fountain 18 ejected from the jet body 16 to leave the canister housing 12. The housing lid 14 is not limited to circular, and can be any shape that cooperates with the open top of the canister housing 12. Jet body 16 and nozzle 54 can be seen through water fountain port 50.

Figure 4:
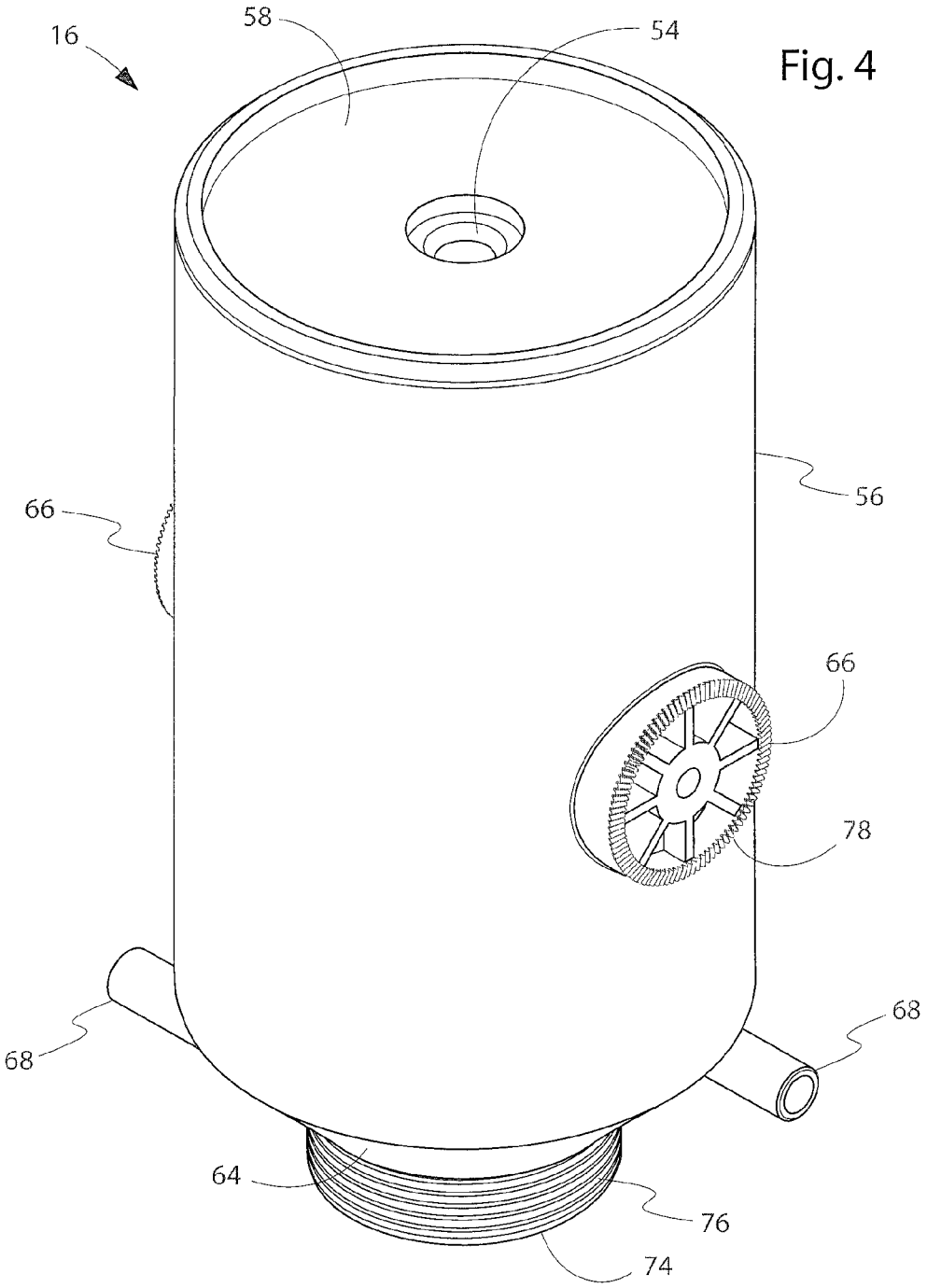
FIG. 4 is a side perspective view of the jet body.

FIG. 4 shows an exemplary side perspective view of the jet body 16. The jet body 16 defines a substantially cylindrical structure having a cylindrical side wall 56, a top wall 58, a bottom wall 60, and a hollow interior 62. The jet body 16 also can have a funnel-shaped portion 64 between the side wall 56 and the bottom wall 60, in which case the bottom wall 60 will have a smaller diameter than the side wall 56. The top wall 58 comprises a nozzle 54 for producing the water fountain 18. The side wall 56 comprises at least one connection structure 66 for connecting the jet body 16 to the jet body supports 52 of the housing lid 14. The funnel-shaped portion 64, or the side wall 56, comprises at least one water inlet port 68 for receiving a flow of water 22 from the water inlet 34 of the canister housing 12, or a water flow splitter 70. The bottom wall 60 comprises an opening 74 allowing access to the hollow interior 62 of the jet body 16.

In the exemplary embodiment shown in FIG. 4, the jet body 16 comprises two water inlet ports 68, one nozzle 54, two connection structures 66, and a threaded connection 76 to opening 74. Water inlet ports 68 are preferably mounted tangentially or approximately tangentially on side wall 56 or funnel-shaped portion 64 so as to provide a less turbulent flow of water 22 into jet body 15. Alternatively, one or three or more water inlet ports 68 can be used. The single nozzle 54 is located centrally on top wall 58, but can be located at any place on top wall 58. Alternatively, jet body 16 can comprise two or more nozzles 54 for different fountain effects. The two connection structures 66 cooperate with jet body supports 52 for supporting the jet body 16 on the housing lid 14 in the canister housing 12, as disclosed herein. Teeth 78 on the outer lateral surface of connection structure 66 cooperate with teeth or ratchets 80 on the jet body supports 52 to maintain jet body 16 in a set but changeable position relative to housing lid 14. Teeth 78 and teeth or ratchets 80 allow jet body 16 to be rotated relative to jet body supports 52 to change the position of jet body 16 relative to housing lid 14 so as to allow water fountain 18 to be set at a desired angle. Threaded connection 76 on opening 74 allows a cap 82 to be secured to the opening 74.

Figure 5:
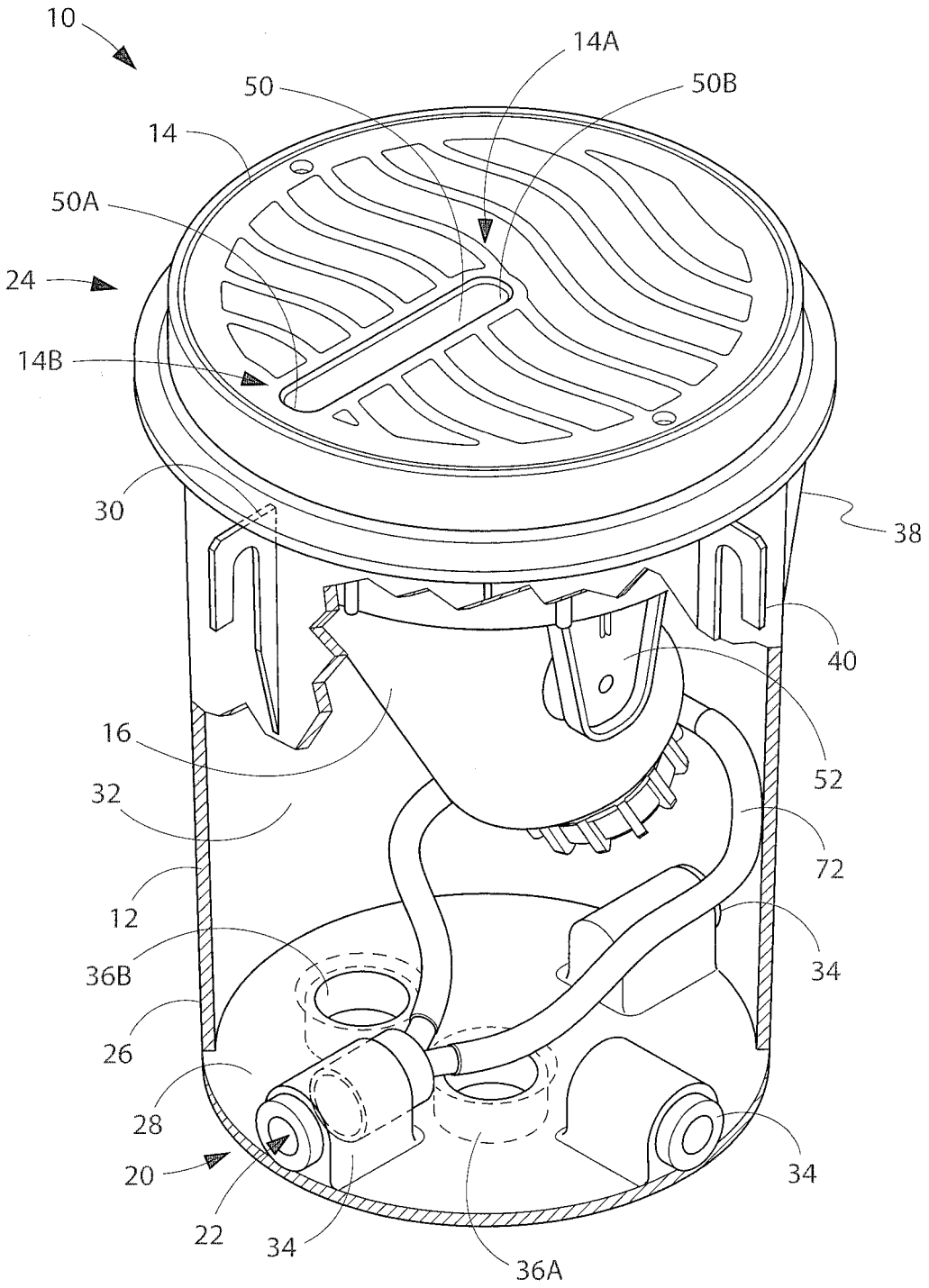
FIG. 5 is a side perspective view of the water fountain device with the canister housing shown clear so as to provide a view of the interior configuration of the device.

FIG. 5 shows an exemplary side perspective view of the water fountain device 10 with the canister housing 12 shown clear so as to provide a view of the interior configuration of the device 10. In this figure, and also in FIGS. 6-10, jet body 16 is shown supported on jet body supports 52 and suspended within the hollow interior 32 of canister housing 12, with housing lid 14 resting on the top of the canister housing 12 covering open top 30. As in FIG. 2, two wiring inlet/drain combinations 36 are shown, one of which can be used for electrical wiring 42 for supplying electricity to, for example, the light 44, and the other of which can be used as a drain for any water collecting in the housing canister 12. Three water inlets 34 are shown on side wall 26 of canister housing 12, spaced about the perimeter of canister housing 12. While only one water inlet 34 is necessary, the presence of additional water inlets 34 allows flexibility in the placement of water feed lines and/or of the device 10 relative to the water body. If only one water inlet 34 is used, then any other water inlets 34 can be closed with plugs or caps. If two water inlets are used, such as, for example, using a first water inlet 34 to connect to a first water inlet port 68 and a second water inlet 34 to connect to a second water inlet port 68, then any remaining water inlet ports 34 can be closed with plugs or caps.

The water inlet 34 can comprise a water flow splitter 70, either as part of the water inlet 34 or a separate structure that cooperates with the water inlet 34, configured to split the flow of the incoming water 22 into at least two flows of water 22A, 22B that are provided to the jet body 16, namely, to the two water inlet ports 68. Flexible tubes 72, such as rubber or silicon, connect the splitter 70 to the jet body 16. For example, flexible tubes 72 can connect the water inlet 34 of the canister housing 12, or the water flow splitter 70, to the at least one water inlet port 68 of the jet body 16. Flexible tubes 72 should be of a length sufficient to connect splitter 70 to water inlet ports 68 with a sufficient slack or extra length to accommodate the rotational movement of jet body 16 on jet body supports 52.

Figure 6:
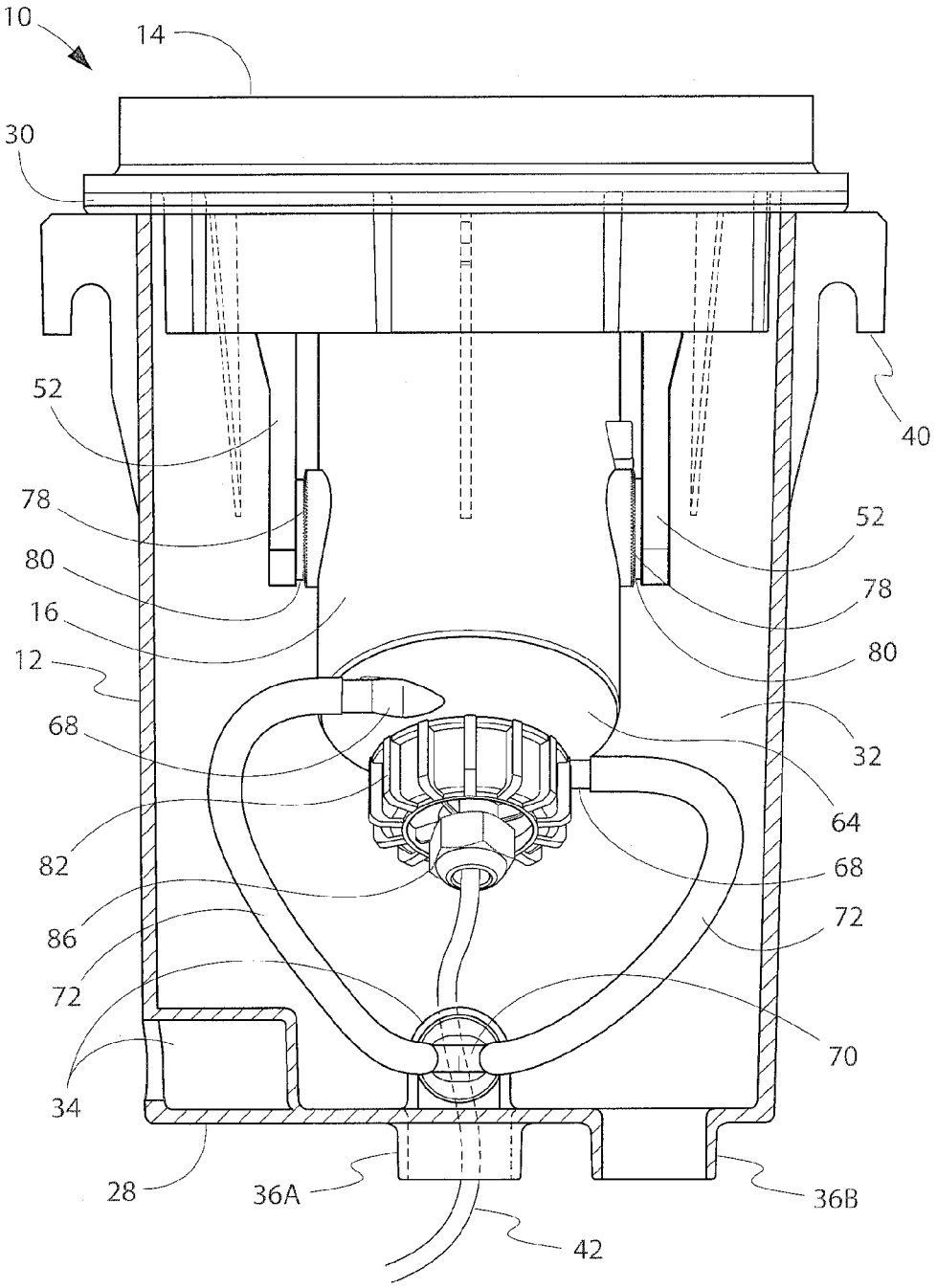
FIG. 6 is a first side view of the water fountain device with the canister housing shown clear so as to provide a view of the interior configuration of the device.

FIG. 6 shows an exemplary first side view of the water fountain device 10 with the canister housing 12 shown clear so as to provide a view of the interior configuration of the device 10. In this view, the cooperation of the connection structure 66 to the jet boy support 52 can be seen in more detail. For example, teeth or ratchet 80 on jet body support 52 cooperate with teeth 78 on connection structure 66 to hold jet body in a first set position relative to housing lid 14, with the result that nozzle 54 is in a first position relative to water fountain port 50. Teeth or ratchet 80 have a sufficient flexibility, or jet body support 52 has a sufficient flexibility, such that jet body 16 can be rotated about an axis through the centers of connection structures 66 and relative to jet body supports 52 whereby teeth 78 move relative to teeth or ratchet 80 whereby jet body can be moved to a second set position relative to housing lid 14, with the result that nozzle 54 is in a second position relative to water fountain port 50. Preferably two jet body supports 52 depend downward from the bottom (interior) surface of the housing lid 14 into the canister housing 12 for holding the jet body 16 in an adjustable manner.

FIG. 6 also shows two flexible tubes 72 extending from the two outlets of splitter 70 to two water inlet ports 68 on the jet body 16. FIG. 6 further shows more detail for an exemplary embodiment of cap 82 of jet body opening 74. The exemplary cap 82 comprises an opening 84 therethrough, which is covered by or connected to a nut 86. Opening 84 allows electrical wiring 42 to extend therethrough from wiring inlet 36A to hollow interior 62 of jet body 16, where it can connect ultimately with light 44. The exemplary nut 86 can comprise a seal whereby when the electrical wiring 42 extends through the nut 86, the seal surrounds the electrical wiring 42 preventing water 22 from exiting the hollow interior 62 of jet body 16 through nut 86. Due to the structure of the lighting support 88 disclosed herein, and the cooperation between the lighting support 88 and a directional wall 90 within jet body 16 disclosed herein, such a seal can be unnecessary. In an alternative embodiment of cap 82, useful when no light 44 is used or when light 44 is a self-contained battery-operated light, cap 82 can be a solid cap with no opening 84 therethrough, which is screwed or otherwise attached to threaded connection 76 or opening 74, thus completely closing opening 74.

Figure 7:
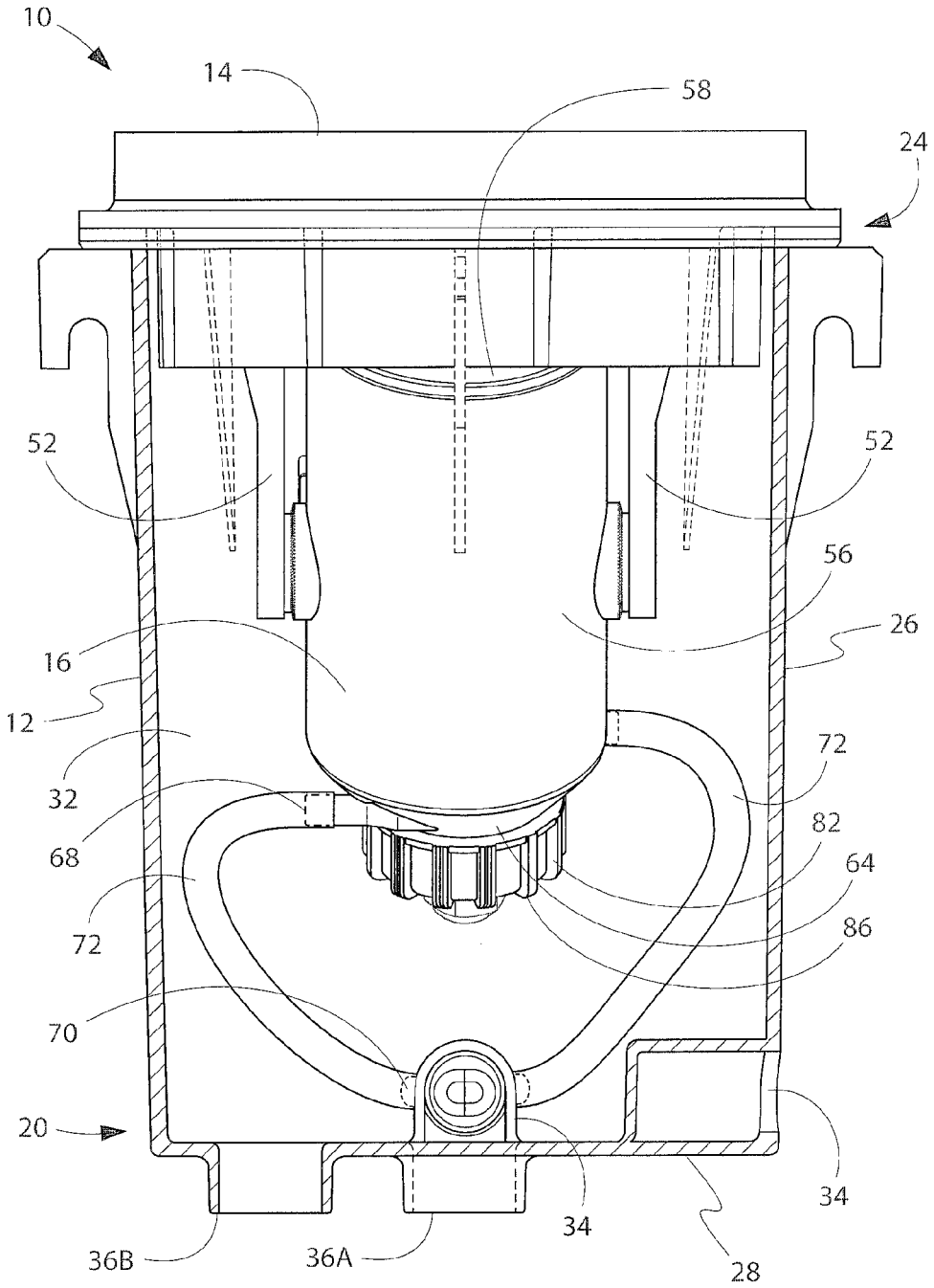
FIG. 7 is a second side view of the water fountain device, rotated 180° from the first side view of FIG. 6, with the canister housing shown clear so as to provide a view of the interior configuration of the device.

FIG. 7 shows an exemplary second side view of the water fountain device 10, rotated 180° from the first side view of FIG. 6, with the canister housing 12 shown clear so as to provide a view of the interior configuration of the device 10. FIG. 7 provides additional visual detail of the structure and arrangement of the device 10.

Figure 8:
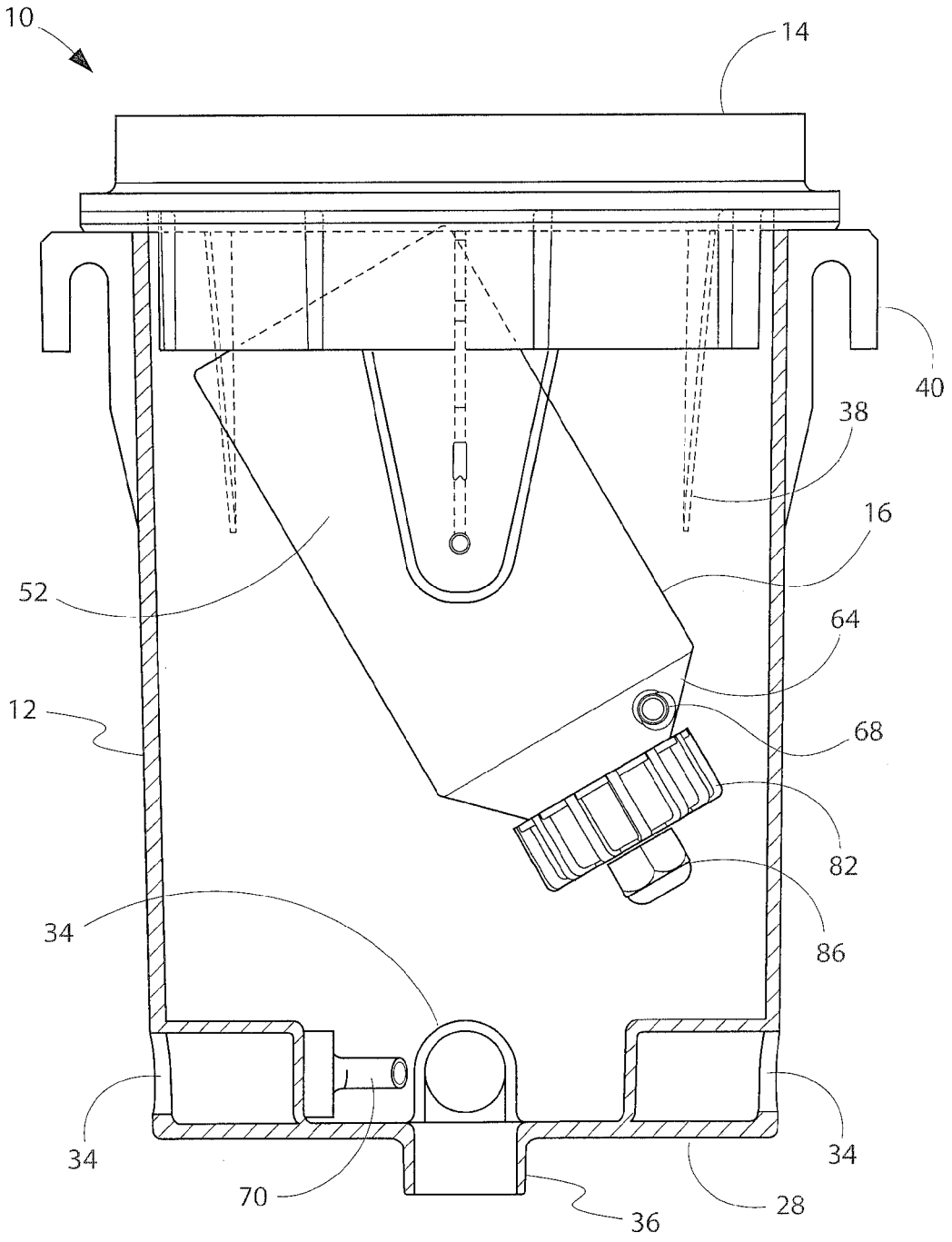
FIG. 8 is a third side view of the water fountain device, rotated 90° from the first side view of FIG. 6, with the canister housing shown clear so as to provide a view of the interior configuration of the device.

FIG. 8 shows an exemplary third side view of the water fountain device 10, rotated 90° from the first side view of FIG. 6, with the canister housing 12 shown clear so as to provide a view of the interior configuration of the device 10. FIG. 8 provides additional visual detail of the structure and arrangement of the device 10.

Figure 9:
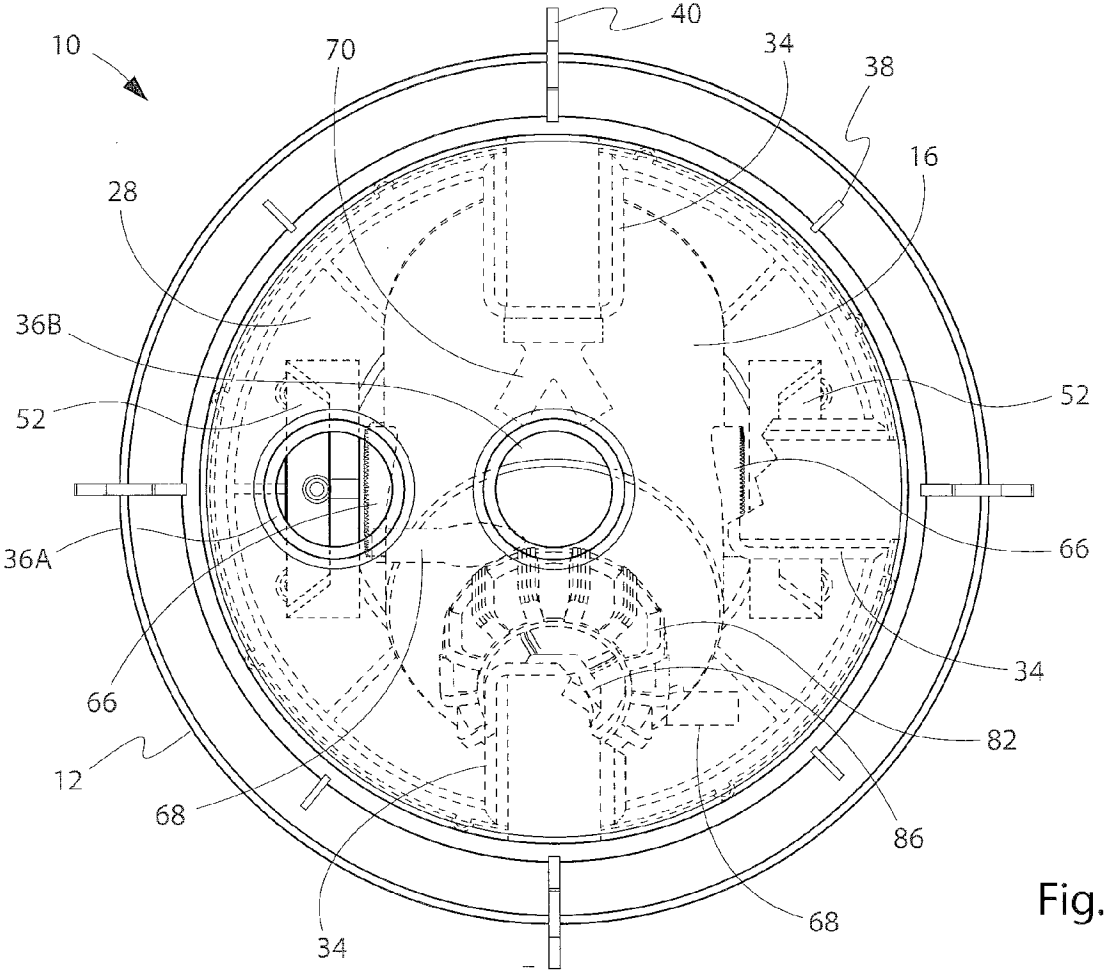
FIG. 9 is a bottom view of the water fountain device with the canister housing shown clear so as to provide a view of the interior configuration of the device.

FIG. 9 shows an exemplary bottom view of the water fountain device 10 with the canister housing 12 shown clear so as to provide a view of the interior configuration of the device 10. FIG. 9 provides additional visual detail of the structure and arrangement of the device 10. FIG. 9 also provides additional visual detail of the tangential arrangement of water inlet ports 68 on the funnel-shaped portion 64 of jet body 16, which also is disclosed in more detail herein.

Figure 10:
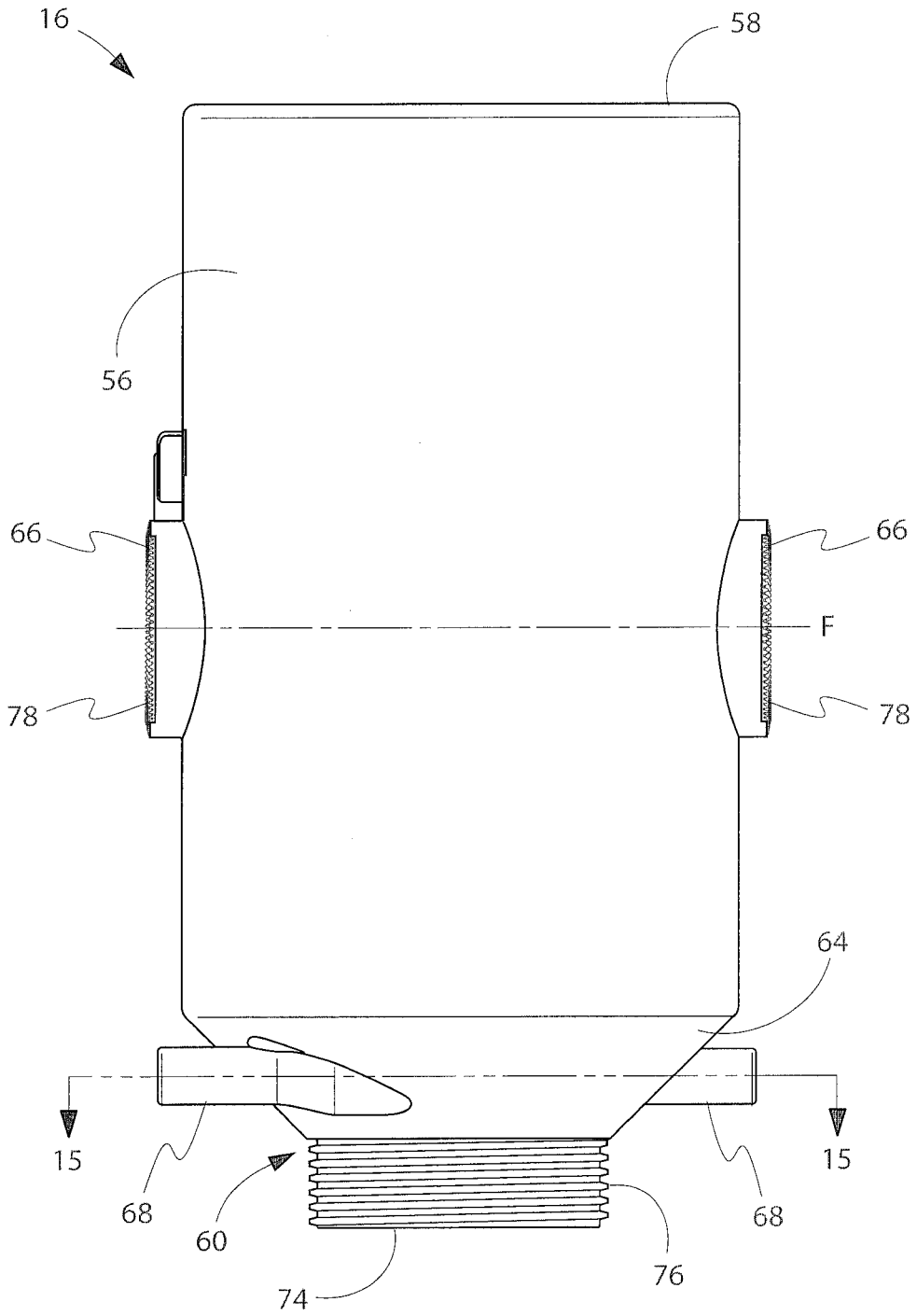
FIG. 10 is a first side view of the jet body.

FIG. 10 shows an exemplary first side view of the jet body 16. This view illustrates the positioning of the connection structures 66 for supporting the jet body 16 on the jet body supports 52. When two connection structures 66 are used in combination with two jet body supports 52, the connection structures 66 are located diametrically opposite each other on the outer surface of the side wall 56 of the jet body 16, with a horizontal axis F through the centers of the circular connection structures 66 about which the jet body 16 can rotate when supported on the jet body supports 52. This view also illustrates the relative positioning of the water inlet ports 68 on the funnel-shaped portion 64 of the jet body 16. Lid 92 of jet body 16 can be removed for additional access to the hollow interior 62 of the jet body 16.

Figure 11:
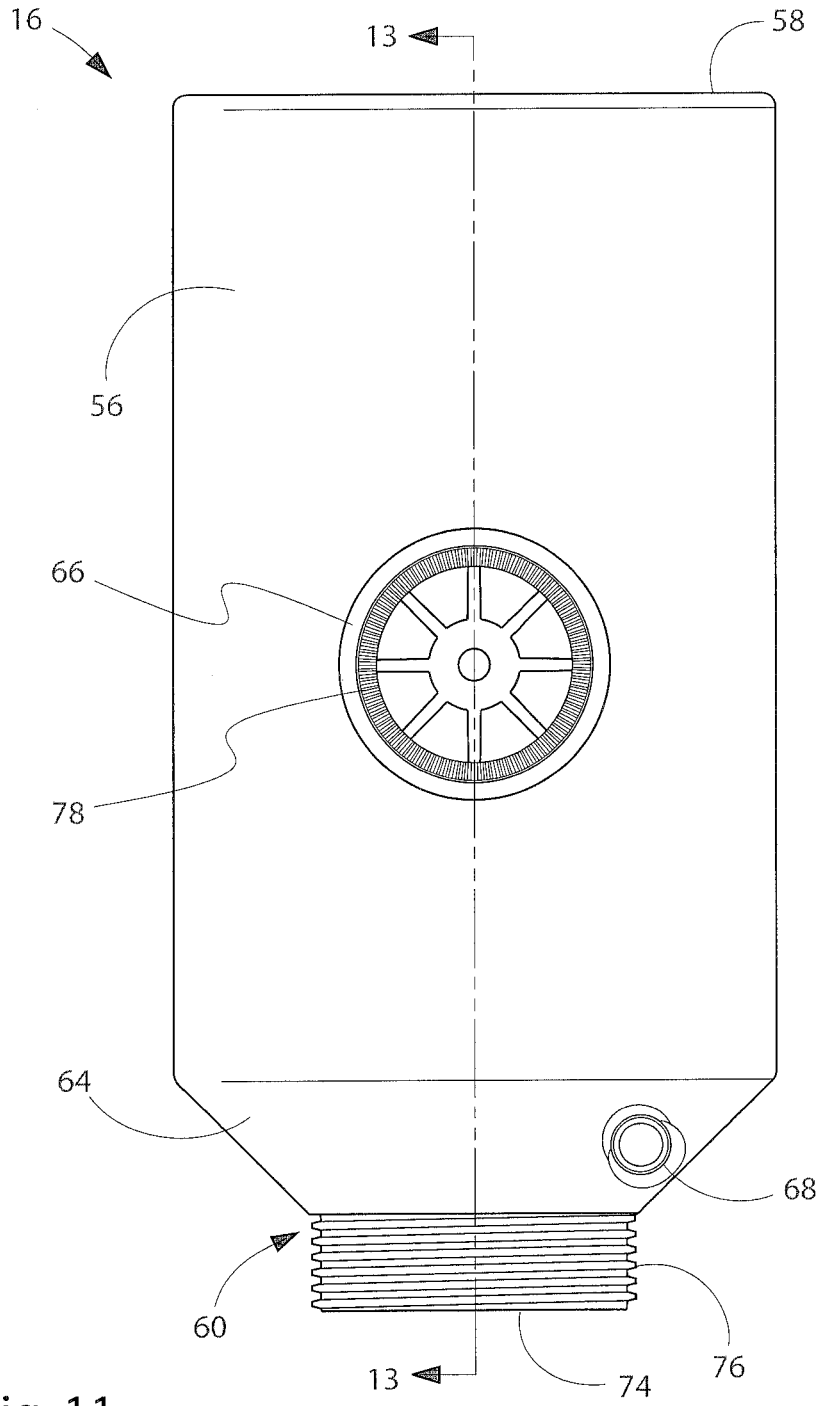
FIG. 11 is a second side view of the jet body rotated 90° from the first side view of FIG. 10.

FIG. 11 shows an exemplary second side view of the jet body 16 rotated 90° from the first side view of FIG. 10. This view illustrates the circular structure of the connection structures 66, also shown in more detail in FIG. 17. Axis F shown in FIG. 10 extends perpendicularly into the page at the center of connection structure 66. This view also illustrates the generally tangential placement of water inlet port 68 on funnel-shaped portion 64 of jet body 16. As disclosed herein, this placement of water inlet port 68 allows water 22 to be injected into the hollow interior 62 of jet body 16 either circumferentially about the inner surface of side wall 56 of jet body 16 or along the interior of an annular ring 94 within the jet body 16.

Figure 12:
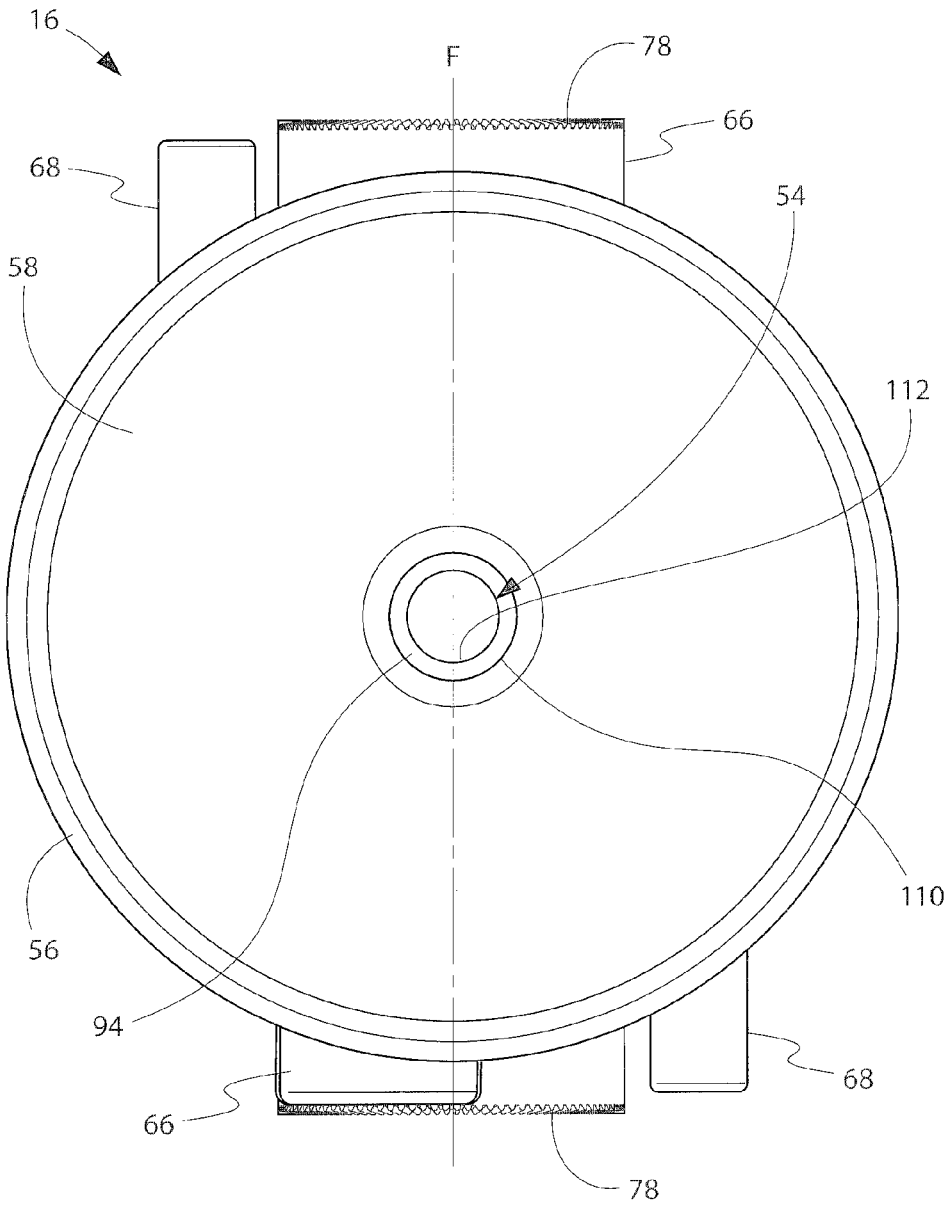
FIG. 12 is a top view of the jet body.

FIG. 12 shows an exemplary top view of the jet body 16. This view illustrates the central positioning of the nozzle 54 on the top wall 58 of the jet body 16. As disclosed in more detail herein in connection with FIG. 16, nozzle 54 comprises a tapered surface 94 to reduce contact with the water fountain 18. Although one nozzle 54 is shown located centrally on top wall 58, nozzle 54 can be located at any place on top wall 58. Alternatively, top wall 58 can comprise two or more nozzles 54 for different fountain effects. This view also illustrates the positioning of two connection structures 66 for supporting the jet body 16 on the jet body supports 52, namely, being located diametrically opposite each other on the outer surface of the side wall 56 of the jet body 16, with a horizontal axis F through the centers of the circular connection structures 66 about which the jet body 16 can rotate when supported on the jet body supports 52. This view further also illustrates the relative positioning of the water inlet ports 68 on the jet body 16.

Figure 13:
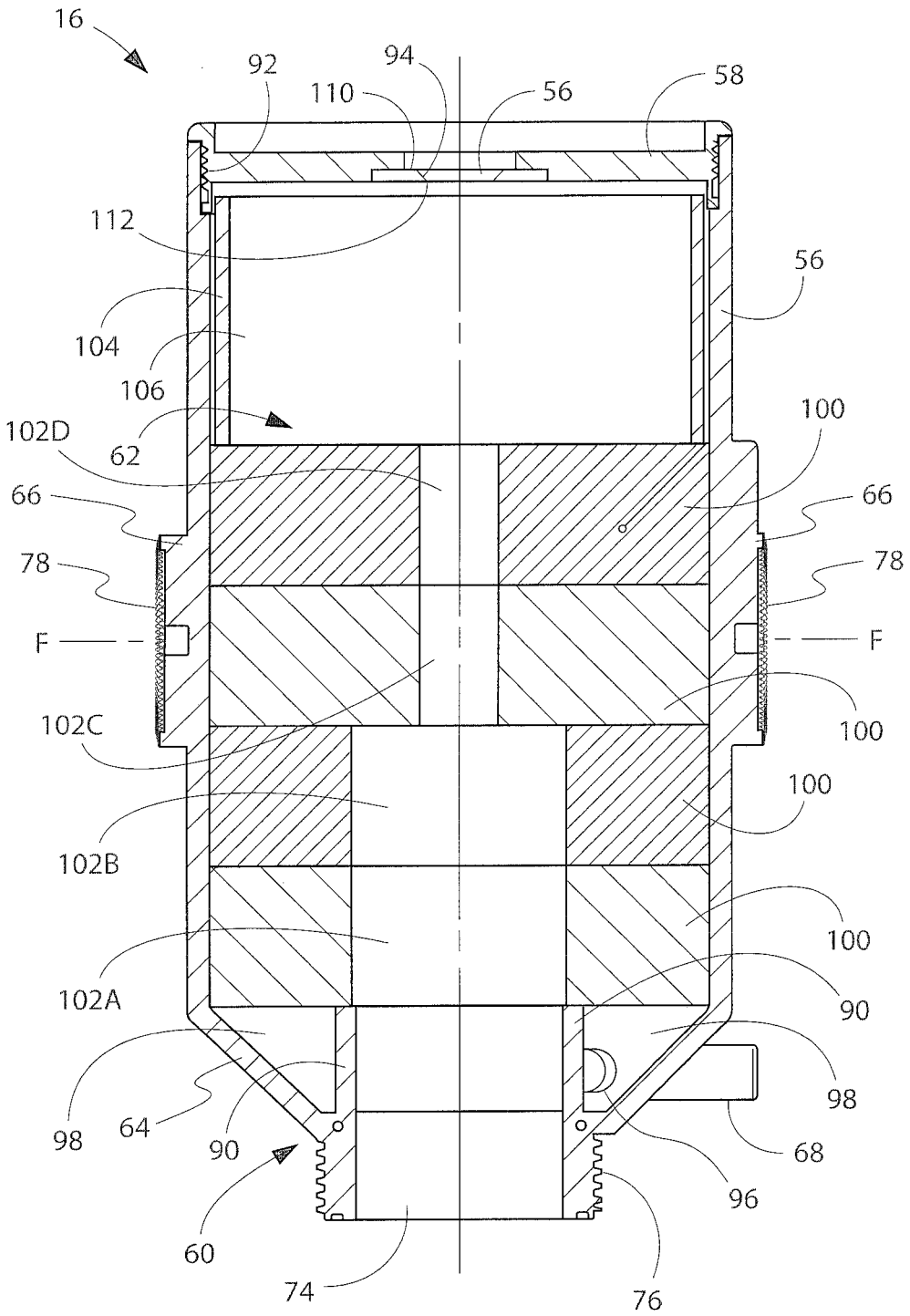
FIG. 13 is a sectional side view of the jet body along line A-A of FIG. 11.

FIG. 13 shows an exemplary sectional side view of an exemplary jet body 16 along line A-A of FIG. 11. Cylindrical side wall 56 forms a primary structure of jet body 16, providing an outer surface for connection structures 66, a lower end for funnel-shaped region 64, and an upper end for cooperating with lid 92. The funnel-shaped portion 64 is an extension of or is attached to the lower end of side wall 56 and angles inwardly towards the axial center of hollow interior 62. The opening 74 is an extension of or is attached to and extends downwardly from the lower end of funnel-shaped portion 64. Preferably, side wall 56, hollow interior 62, funnel-shaped portion 64, and opening 74 are coaxial. Inlet water ports 68 are connected to funnel-shaped portion 64 whereby water 22 can enter funnel-shaped portion 64 through openings 96. Within the hollow interior 62 of the jet body 16 there can be directional walls 90 for directing the water flow through the jet body 16, filter elements 98 for filtering the water flow, and lighting elements 44 for lighting the water flow.

A directional wall 90 can extend upwardly from the opening 74 in the bottom wall 60 a certain height within the hollow interior 62 of the jet body 16. Preferably, directional wall 90 has a height the same as the vertical height of the funnel-shaped portion 64 so that the top of the direction wall 90 and the transition between the side wall 56 and the funnel-shaped portion 64 are at the same horizontal plane normal to the central axis G of the jet body 16. Opening 74 and directional wall 90 can be a single cylindrical structure coaxial with the side wall 56 and having a diameter smaller than the diameter of the side wall 56 of the jet body 16. Directional wall 90 and funnel-shaped portion 64 together form an annular region 98, the annular region 98 preferably bound by the directional wall 90 and the funnel-shaped portion 64 and opening upwards into the hollow interior 62 of the jet body 16 towards the top wall 58. Inlet water ports 68 are connected to funnel-shaped portion 64 whereby water 22 can enter funnel-shaped portion 64 through openings 96, and thereby enter the annular region 98.

A filter element or elements 100 can be used to promote laminar flow of the water flow through the hollow interior 62 of the jet body 16 and to mechanically filter debris from the water flow. The filter elements 100 can be at least partially supported by the directional wall 90 and the transition between the side wall 56 and the funnel-shaped portion 64, leaving the annular region 98 open. In effect, in this exemplary embodiment, the annular region 98 has a triangular, generally triangular, or three-sided vertical cross-section with the sides of the annular region 98 being the directional wall 90, the funnel-shaped portion 64, and the filter element 100. Filter elements 100 can be any filter element, woven or non-woven, open-cell foam, glass or polyester floss, and the like, and preferably is a non-woven material such as an open cell foam, whereby the water 22 is baffled as it flows through the filter element 100. The filter element 100 can be removable for service and rinsing and cleaning.

In FIG. 13, four separate filter elements 100A, 1008, 100C, 100D are shown stacked in the hollow interior 62 of jet body 16. The exemplary filter elements 100 shown are cylindrical rings having an outer diameter equal to or slightly smaller than the inner diameter of side wall 56, and further having central cores 102 axially therethrough. Central cores 102 are structured to accommodate a lighting support 88, as shown in more detail in FIG. 14. Preferably, at least a portion of the central cores 102, central cores 102A, 102B in FIG. 13, have the same inner diameter as directional wall 90 and opening 74 whereby a lighting support 88 having a similar outer diameter can be inserted into opening 74, directional wall 90 and first and second central cores 102A, 102B. Another portion of lighting support 88 can have a different smaller diameter and can fit within third and fourth central cores 102C, 102D, which are shown as having smaller inner diameters than directional wall 90 and opening 74. Central cores 102 therefore can accommodate and even help support lighting support 88 within hollow interior 62 of jet body 16. With lighting support 88 located within central cores 102, water 22 will not enter central cores 102 from filter elements 100, and water 22 will continue to be forced through filter elements 100 from annular region 98 to manifold region 106. Alternatively, a single filter element 100 can be used having a formed core 102 shaped to accommodate the lighting support 88. If no lighting support 88 is used, filter elements 100 of non-woven materials can be cylindrical discs.

A retaining ring 104 or cylinder can be inserted into the hollow interior 62 of jet body 16 above filter elements 100 so as to hold filter elements 100 in place within jet body 16 and to create a manifold region 106 within jet body 16. Retaining ring 104 can be held in place by housing lid 14. Manifold region 106 can help create a reservoir of laminar flowing water 22 within jet body 16 so as to help create the laminar water fountain 18. The manifold region 106 can be left between the top filter element 100, or the top of the filter element 100, and the top wall 58 to serve as a manifold region 106 for the water flow.

The at least one water inlet port 68 to the jet body 16 preferably is located on the funnel shaped portion 64, or on the lower end of the side wall 56 of the jet body 16, whereby the water flow is directed into the lower portion of the hollow interior 62 of the jet body 16, preferably into the annular region 98. The at least one water inlet port 68 preferably is mounted so as to provide a tangential flow of water 22 into the jet body 16 through openings 96 so as to allow more lateral fluid and pressure distribution of the water 22 into the jet body 16. In this manner, the water flow into the jet body 16 is directed circumferentially around the outer surface of the inner wall of the cylindrical side wall 56, or circumferentially within the annular region 98. As the annular region 98 fills, or is filled, the water flow is forced upwards into the main portion of the hollow interior 62, preferably through the filter element 100, into manifold region 106, and then out of the nozzle 54 in the top wall 58.

Figure 14:
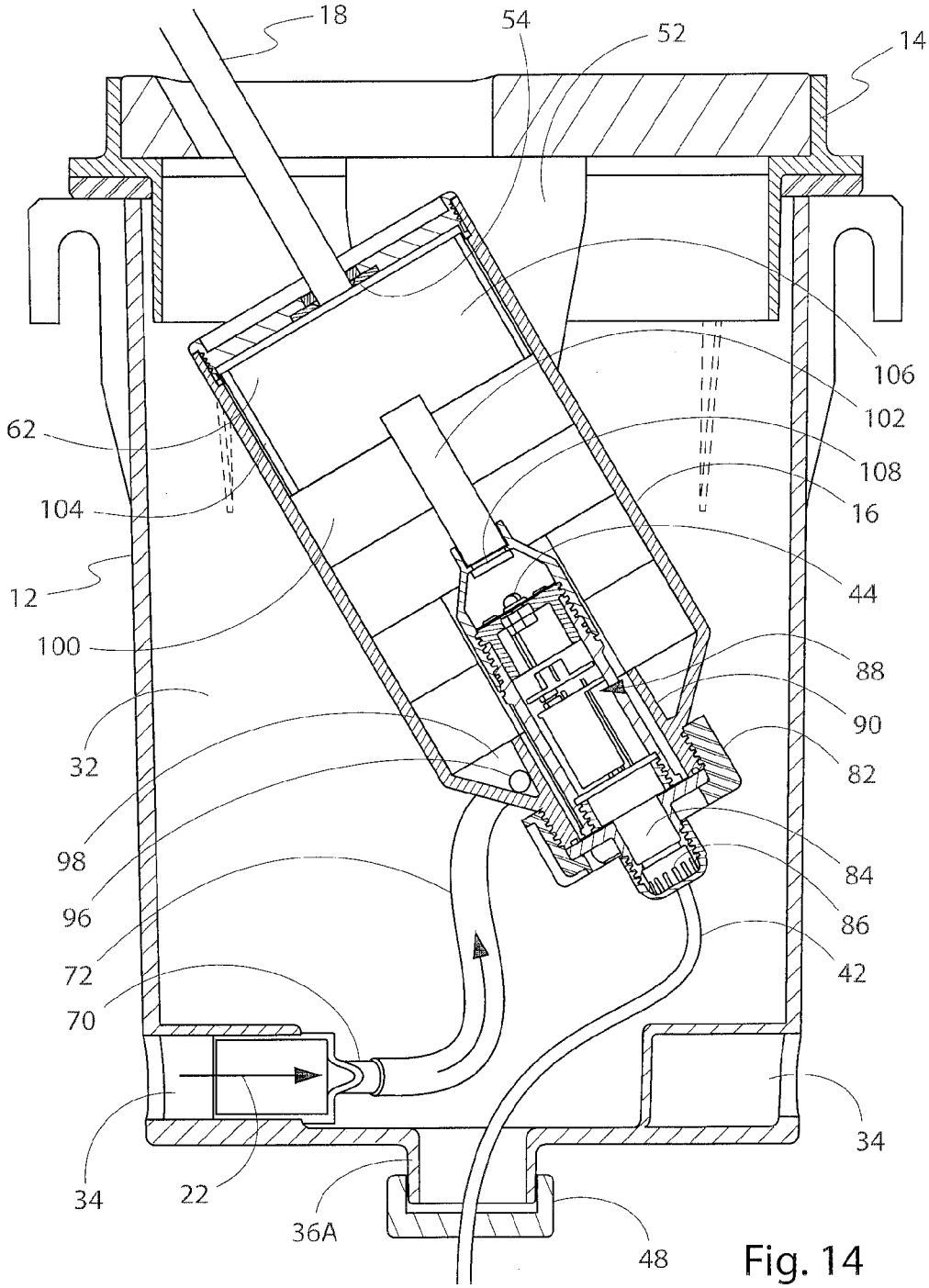
FIG. 14 is a sectional side view of the water fountain device along line E-E of FIG. 8.

FIG. 14 shows an exemplary sectional side view of the water fountain device 10 along line E-E of FIG. 8. This view discloses the relationship between nozzle 54 and water fountain port 50 in more detail and, in conjunction with FIG. 13, discloses the inner components and structure of jet body 16, such as a lighting support 88, in more detail. When housing lid 14 is in the proper position on canister housing 12, water fountain port 50 provides an opening through housing lid 14 into the hollow interior 32 of canister housing 12. In the exemplary embodiment of water fountain port 50, the outer or circumferential end 50A of water fountain port 50 can have an inwardly downwardly sloping surface and the inner or central end 50B of water fountain port 50 can has a vertical surface to cooperate with the water fountain 18 emanating from nozzle 54. As shown in FIG. 10, jet body 16 is supported by jet body supports 52 at a non-vertical angle, whereby water fountain 18 emanates from nozzle 54 at a non-vertical angle towards and through circumferential end 50A of water fountain port 50. Similarly, if jet body 16 were to be supported by jet body supports 52 at a vertical angle, water fountain 18 would emanate from nozzle 54 at a vertical angle towards and through central end 50 B of water fountain port 50. Alternatively, if water fountain port 50 were to be an opening across the entire diameter of housing lid 14, water fountain port 50 would have two circumferential ends 50A.

FIG. 14 also shows an exemplary embodiment of a lighting element 44 on a lighting support 88 that can light the water flow so as to produce a lighted water fountain 18 emanating from the water fountain device 10 for aesthetic purposes. A lighting support 88 can be inserted through the opening 74 in the bottom wall 60 into the hollow interior 62 of the jet body 16. The lighting structure 88 can be supported by the directional wall 90 and/or a closing cap 82. The lighting structure 88 extends at least partway upwards within the hollow interior 62 of the jet body 16 whereby the light 44 can be directed into the water flow and/or the water in manifold region 106 and then out of the jet body 16 through the nozzle 54 so as provide for a lighted water fountain 18. When using a lighting support 88 and a filter element 100, the filter element 100 must have a hollow central core 102 region, namely an annular filter element 100, whereby the lighting support 88 can fit within the central core 102 so as to provide unblocked light to the water flow and/or the water in the manifold region 106.

An exemplary lighting support 88 can be a generally cylindrical structure sized to fit within the central core 102 and to contain the light 44 and any electrical wiring 42 or other components (electrical contacts, batteries, etc.) necessary to operate the light 44. For example, the lighting support 88 shown in FIG. 14 is a structure approximately the size of first and second central cores 102A, 102B and is held within central cores 102 by cap 82. In the illustrative lighting support 88 shown in FIG. 14, the top end of the lighting support 88 ends proximal to the top of central core 102B and does not need to extend, or only extends, a short distance into central core 102C. Electrical wiring 42 to operate the light 44 extends out of the bottom of the lighting support 88 and through cap 82 and nut 86 to a source of electricity.

Lighting support 88 preferably is a sealed structure so as to prevent water 22 from entering the interior of the lighting support 88 and adversely affecting the light 44 and electrical wiring 42. Lighting support 88 preferably is manufactured form a clear material, such as a clear plastic, or has a clear lens 108 directed towards the nozzle 54, so that light from lighting element 44 can shine into the water 22 in the jet body 16 and therefore into the water fountain 18. A preferred lighting element is a light emitting diode (LED).

In an alternate embodiment, lighting support 88 can be constructed in a cartridge form, either with or without the cap 82 as a component. For example, lighting support 88 can be a single cartridge component having a shape that approximates or cooperates with the shape of central core 102, or with parts of central core 102A, 102B, 102C, and/or 102D, so as to fit within central core 102 with the light 44 positioned to shine upwards through manifold region 102 and into water 22 within manifold region 102 and/or out through nozzle 54 to light the water fountain 18. If cap 82 is a component of the cartridge, electrical wiring 42 to operate the light 44 extends out of the bottom of the cap 82 and nut 86 may not be necessary. If cap 82 is not a component of the cartridge, electrical wiring 42 to operate the light 44 extends out of the bottom of the lighting support 88 and through cap 82 and nut 86 to a source of electricity.

In another alternate embodiment, lighting support 88 can be constructed as a standalone battery-powered device, either with or without the cap 82 as a component. For example, lighting support 88 can be a single cartridge component having a shape that approximates or cooperates with the shape of central core 102, or with parts of central core 102A, 102B, 102C, and/or 102D, so as to fit within central core 102 with the light 44 positioned to shine upwards through manifold region 102 and into water 22 within manifold region 102 and/or out through nozzle 54 to light the water fountain 18. As a self-contained device, electrical wiring 42 extending out of lighting support 88 to an electrical source is not necessary. If cap 82 is a component of the cartridge, the entire lighting support 88 can be screwed secured onto opening 74 via the cap 82 component, and nut 86 may not be necessary. If cap 82 is not a component of the cartridge, the lighting support 88 cartridge can be inserted into central core 102 and secured there by cap 82, and nut 86 may not be necessary.

Figure 15:
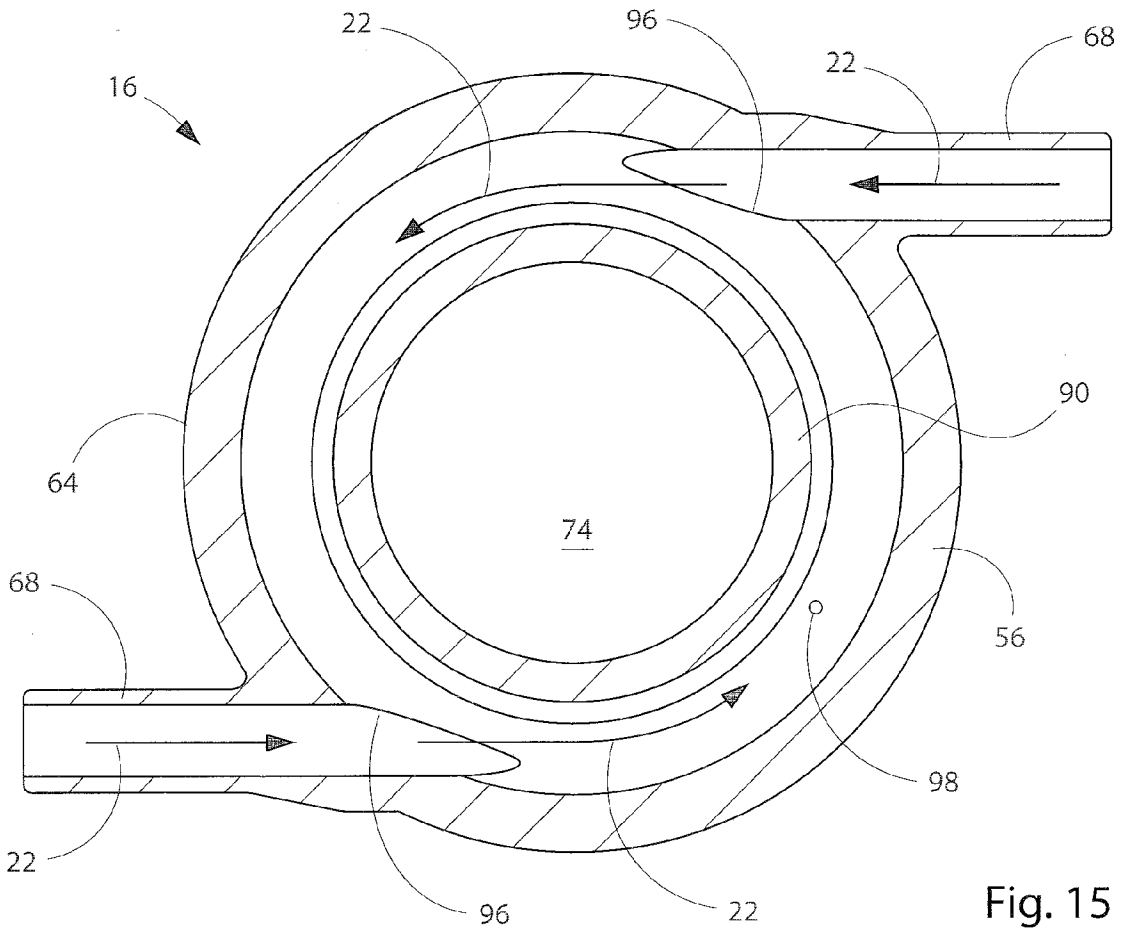
FIG. 15 is a sectional view of the water inlets to the jet body along line C-C of FIG. 10.

FIG. 15 shows an exemplary sectional view of the water inlets ports 68 to the jet body 16 along line C-C of FIG. 10. Water 22 flows through both water inlet ports 68 and into annular region 98 through openings 96. As water 22 is directed generally tangentially, it can flow directly into the annular region 98 in a less turbulent manner than if water inlet ports 68 were perpendicularly located on funnel-shaped portion 64. Specifically, the use of tangentially located water inlet ports 68 helps prevent water 22 from being directed directly at directional wall 90. Water 22 flows into annular region 98 and then is forced upwards into the main volume of hollow interior 62 of jet body 16, preferably into filter elements 100.

Figure 16:
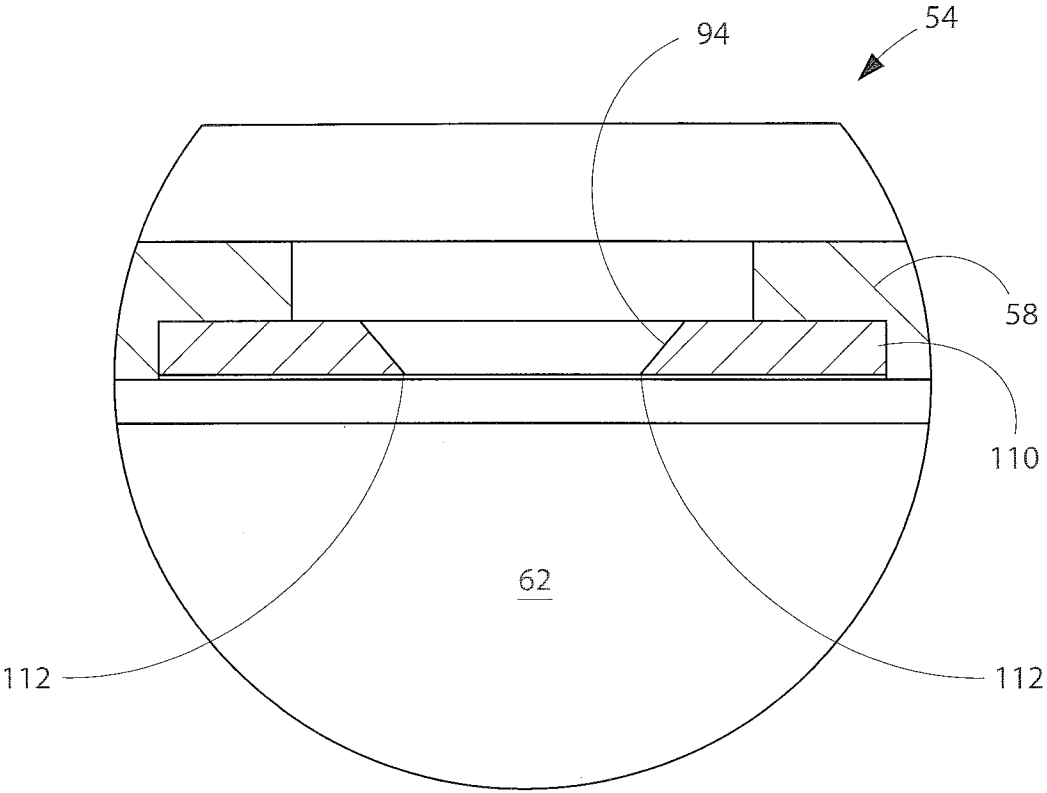
FIG. 16 is a sectional side view of the nozzle of detail B of FIG. 13.

FIG. 16 shows an exemplary sectional side view of the nozzle 54 of detail B of FIG. 13. Minimizing the surface area of the nozzle 54, which is the water outlet opening from the jet body 16, also optimizes the water pattern of the water fountain 18. To help accomplish this, a preferred embodiment of nozzle 54 comprises a brass insert 110 with a knife edge 112 and a tapered surface 94. Thus, water being forced out of the hollow interior 62 of jet body 16 is formed into the water fountain 18 by the knife edge 112 of the nozzle 54. The combination of the knife edge 112 and the tapered surface 94 helps prevent the water from contacting the tapered surface 94, resulting in a more optimized rod-shaped, circular cross-section water fountain 18.

Figure 17:
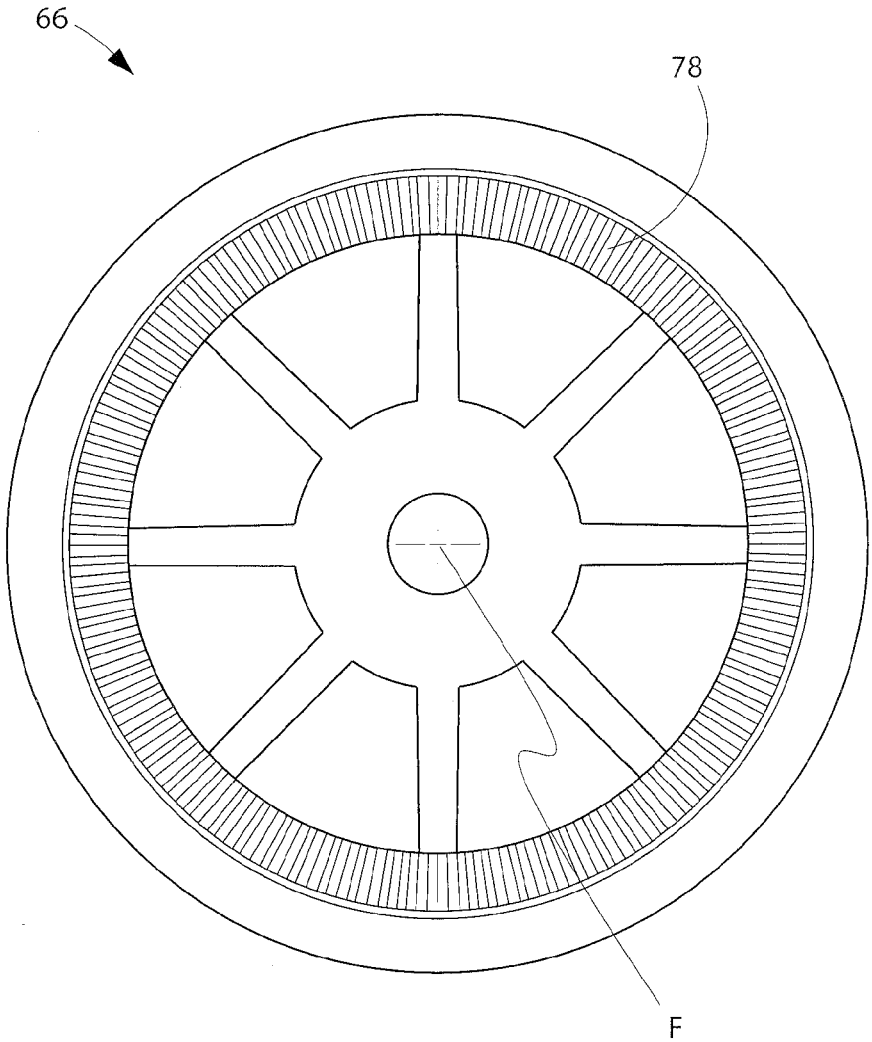
FIG. 17 is a side view of the connection structure on the outer side wall of the jet body of detail D of FIG. 11.

FIG. 17 shows an exemplary side view of the connection structure 66 on the outer side wall 56 of the jet body 16 of detail D of FIG. 11. This view illustrates the circular structure of the connection structures 66. Axis F shown in FIG. 10 extends perpendicularly into the page at the center of connection structure 66. Teeth 78 on the outer lateral surface of connection structure 66 cooperate with teeth or ratchets 80 on the jet body supports 52 to maintain jet body 16 in a set but changeable position relative to housing lid 14. Teeth 78 in cooperation with teeth or ratchets 80 allow jet body 16 to be rotated relative to jet body supports 52 to change the position of jet body 16 relative to housing lid 14 so as to allow water fountain 18 to be set at a desired angle. For example, jet body 16 can be rotated about axis F whereby jet body can be moved to various set positions relative to housing lid 14, with the result that nozzle 54 can be placed in or moved to set positions relative to water fountain port 50 as desired by the user.

In use, the device 10 is placed in an appropriate place and position relative to a water body, such as a pre-formed hole in the decking or concrete proximal to the body of water. A water source is attached to water inlet 34 of canister housing 12 and the electrical wiring 42, if present, is attached to an electrical source. The jet body is rotated relative to the jet body supports 52 to a desired position depending on the angle desired for the resulting water fountain 18. Water 22 then is supplied to the device 10.

As water 22 enters the device 10, the water 22 flows through the water inlet 34 of the canister housing 12, through flexible tubes 72 to the water inlet ports 68 of the jet body 16, and into the hollow interior 62 of the jet body 16. If a water flow splitter 70 is present in the water inlet 34 of the canister housing 12, the water 22 flow is split into at least two water flows to at least two flexible tubes 72, and then through the at least two flexible tubes 72 to the at least two water inlet ports 68 of the jet body. The water 22 then enters the annular region 98 in a tangential manner, fills the annular region 98, and moves upwards within the hollow interior 62 of the jet body 16. If filter elements 100 are present, the water 22 flows through the filter elements where turbulence can be removed or lessened and debris removed. If a manifold region 106 is present, the water 22 then flows into the manifold region 106.

The water 22 then encounters the nozzle 54 on the top wall 56 of the jet body. The water pressure of the water incoming to the jet body 16 forces the water 22 out of the jet body 16 through the nozzle 54 as a water fountain 18. The water fountain 18 then passes through the water fountain port 50 of the housing lid 14 and into the water body. If a light 44 is present, the light can be energized to provide light to the water 22 in the jet body 16 and to the water fountain 18.

The various components of the device 10 can be manufactured from plastics, metals, ceramics, composites, and other materials that are known and used in the field.

The above detailed description of the embodiments, and the examples, are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

LIST OF REFERENCE NUMERALS

10 water fountain device
12 canister housing
14 housing lid
14A center of housing lid
14B circumference of housing lid
16 jet body

18 water fountain
20 inlet end of canister housing
22 water
24 outlet end of canister housing
26 side wall of canister housing
28 bottom wall of canister housing
30 open top of canister housing
32 hollow interior of canister housing
34 water inlet of canister housing
36 wiring inlet/drain combination of canister housing
36A wiring inlet of canister housing
36B drain of canister housing
38 spacing ribs of canister housing
40 hooks of canister housing
42 electrical wiring
44 light or lighting element
46 plug
48 cap
50 water fountain port of housing lid
50A circumferential end of water fountain port
50B central end of water fountain port
52 jet body supports
54 nozzle
56 side wall of jet body
58 top wall of jet body
60 bottom wall of jet body
62 hollow interior of jet body
64 funnel shaped portion of jet body
66 connection structure of jet body
68 water inlet port of jet body
70 water flow splitter
72 flexible tubes
74 opening of jet body
76 threaded connection to opening
78 teeth on connection structure
80 teeth or ratchet on jet body support
82 cap on jet body opening
84 opening in cap
86 nut
88 lighting support
90 directional wall of jet body
92 lid of jet body
94 tapered surface of nozzle
96 openings between inlet water ports and funnel-shaped portion
98 annular region
100 filter element
102 central core of filter element
102A first central core
102B second central core
102C third central core
102D fourth central core
104 retaining ring
106 manifold region
108 lens
110 brass insert of nozzle
112 knife edge of nozzle

What is claimed is:

1. A laminar water fountain device comprising a jet body, the jet body comprising:

a) a bottom wall;

b) a top wall opposite the bottom wall;

c) a side wall extending between the bottom wall and the top wall;

d) a hollow interior created by the combination of the bottom wall, the top wall, and the side wall;

e) at least one water inlet port on the side wall for introducing water into the hollow interior of the jet body, the at least one inlet water port mounted tangentially or approximately tangentially on side wall so as to provide a less turbulent flow of water into the jet body; and f) a nozzle for creating a water fountain, the nozzle being located on the top wall and allowing water to flow out of the hollow interior of the jet body as the water fountain;

wherein water is supplied to the jet body and ejected from the jet body as the water fountain; and wherein the nozzle has a structure for minimizing the surface area of the nozzle contacting the water flow being ejected from the jet body so as to optimize the water pattern of the water fountain, wherein the structure form minimizing the surface area comprises a knife edge and a tapered surface, whereby water being ejected out of the jet body is formed into the water fountain by the knife edge.

2. The laminar water fountain device as claimed in claim 1, wherein the at least one water inlet port is located on the side wall proximal to the bottom wall.

3. The laminar water fountain device as claimed in claim 2, wherein the side wall comprises a cylindrical portion and a funnel-shaped portion, the funnel-shaped portion extending between the cylindrical portion and the bottom wall, the funnel-shaped portion having a first larger diameter equal to the diameter of the cylindrical portion and a second smaller diameter equal to the diameter of the bottom wall, and the at least one water inlet port on the side wall for introducing water into the hollow interior of the jet body, wherein the at least one inlet water port is mounted tangentially or approximately tangentially on the funnel-shaped portion.

4. The laminar water fountain device as claimed in claim 3, further comprising a directional wall located within the hollow interior of the jet body and extending upwards from the bottom wall towards the top wall, the direction wall having a diameter less than the diameter of the side wall, whereby the combination of the side wall and the directional wall forms an annular region between the side wall and the directional wall, wherein the at least one water inlet port introduces water into the jet body in the annular region.

5. The laminar water fountain device as claimed in claim 4, wherein the directional wall has a diameter approximately the same as the diameter of the bottom wall and a height at least the same as the height of the vertical height of the funnel-shaped portion, whereby the combination of the funnel-shaped portion of the side wall and the directional wall forms an annular region between the funnel-shaped portion of the side wall and the directional wall, the annular region having a generally three-sided vertical cross-section, wherein the at least one water inlet port introduces water into the jet body in the annular region.

6. The laminar water fountain device as claimed in claim 1, further comprising at least one internal filter element to maintain a less turbulent water flow through the jet body and/or to filter debris from the water flow through the jet body.

7. The laminar water fountain device as claimed in claim 6, further comprising a manifold region between the top of the at least one filter element and the top wall.

8. The laminar water fountain device as claimed in claim 1, further comprising a light located within the hollow interior of the jet body for lighting the water fountain.

9. The laminar water fountain device as claimed in claim 1, comprising at least two water inlet ports.

10. The laminar water fountain device as claimed in claim 1, further comprising a housing for containing the jet body, the housing comprising:

a) a bottom wall;

b) a side wall extending upwards from the bottom wall;

c) a lid for placing on the side wall opposite the bottom wall, the lid comprising a water fountain port for cooperating with the nozzle so as to allow the water fountain to pass through the lid, the lid further comprising at least one jet body support for supporting the jet body within the housing;

d) a hollow interior created by the combination of the bottom wall, the side wall, and the lid; and e) at least one water inlet for introducing water through the hollow interior of the housing to the jet body.

11. The laminar water fountain device as claimed in claim 10, wherein the jet body is at least partially adjustable in the housing such that the angle of the water fountain emanating from the water fountain device is adjustable.

12. The laminar water fountain device as claimed in claim 11, wherein the jet body further comprises at least one connection structure on the outer surface of the side wall of the jet body, wherein the at least one connection structure cooperates with the at least one jet body support for suspending the jet body within the housing, and wherein the jet body is adjustable relative to the at least one jet body support for adjusting the angle of the water fountain emanating from the water fountain device.

13. The laminar water fountain device as claimed in claim 10, further comprising at least one flexible tube for connecting the water inlet of the housing to the at least one water inlet port of the jet body.

14. The laminar water fountain device as claimed in claim 10, wherein the jet body further comprises at least two water inlet ports, wherein the housing further comprises at least two water inlets, and further comprising at least two flexible tubes for connecting the at least two water inlets of the housing to the at least two water inlet ports of the jet body.

15. The laminar water fountain device as claimed in claim 10, wherein the jet body further comprises at least two water inlet ports, wherein the housing further comprises a splitter for splitting the flow of water through the at least one water inlet into at least two water flows, and further comprising at least two flexible tubes for connecting the at least two water flows to the at least two water inlet ports of the jet body.

16. A laminar water fountain device comprising a jet body and a housing, wherein:

a) the jet body comprises:

i) a bottom wall;

ii) a top wall opposite the bottom wall;

iii) a side wall extending between the bottom wall and the top wall;

iv) a hollow interior created by the combination of the bottom wall, the top wall, and the side wall;

v) at least one water inlet port on the side wall for introducing water into the hollow interior of the jet body, the at least one inlet water port mounted tangentially or approximately tangentially on side wall so as to provide a less turbulent flow of water into the jet body; and vi) a nozzle for creating a water fountain, the nozzle being located on the top wall and allowing water to flow out of the hollow interior of the jet body as the water fountain; and the housing comprises:

i) a bottom wall;

ii) a side wall extending upwards from the bottom wall;

iii) a lid for placing on the side wall opposite the bottom wall, the lid comprising a water fountain port for cooperating with the nozzle so as to allow the water fountain to pass through the lid, the lid further comprising at least one jet body support for supporting the jet body within the housing;

iv) a hollow interior created by the combination of the bottom wall, the side wall, and the lid; and v) at least one water inlet for introducing water through the hollow interior of the housing to the jet body;

wherein water is supplied to the jet body and ejected from the jet body as the water fountain.

17. The laminar water fountain device as claimed in claim 16, wherein the at least one water inlet port is located on the side wall proximal to the bottom wall, wherein the side wall comprises a cylindrical portion and a funnel-shaped portion, the funnel-shaped portion extending between the cylindrical portion and the bottom wall, the funnel-shaped portion having a first larger diameter equal to the diameter of the cylindrical portion and a second smaller diameter equal to the diameter of the bottom wall, and the at least one water inlet port on the side wall for introducing water into the hollow interior of the jet body, wherein the at least one inlet water port is mounted tangentially or approximately tangentially on the funnel-shaped portion.

18. The laminar water fountain device as claimed in claim 17, further comprising a directional wall located within the hollow interior of the jet body and extending upwards from the bottom wall towards the top wall, the direction wall having a diameter less than the diameter of the side wall, whereby the combination of the side wall and the directional wall forms an annular region between the side wall and the directional wall, wherein the at least one water inlet port introduces water into the jet body in the annular region.

19. The laminar water fountain device as claimed in claim 18, wherein the directional wall has a diameter approximately the same as the diameter of the bottom wall and a height at least the same as the height of the vertical height of the funnel-shaped portion, whereby the combination of the funnel-shaped portion of the side wall and the directional wall forms an annular region between the funnel-shaped portion of the side wall and the directional wall, the annular region having a generally three-sided vertical cross-section, wherein the at least one water inlet port introduces water into the jet body in the annular region.

20. The laminar water fountain device as claimed in claim 19, further comprising at least one internal filter element to maintain a less turbulent water flow through the jet body and/or to filter debris from the water flow through the jet body.

21. The laminar water fountain device as claimed in claim 20, further comprising a manifold region between the top of the at least one filter element and the top wall.

22. The laminar water fountain device as claimed in claim 16, wherein the nozzle has a structure for minimizing the surface area of the nozzle contacting the water flow being ejected from the jet body so as to optimize the water pattern of the water fountain, wherein the structure form minimizing the surface area comprises a knife edge and a tapered surface, whereby water being ejected out of the jet body is formed into the water fountain by the knife edge.

23. The laminar water fountain device as claimed in claim 16, further comprising a light located within the hollow interior of the jet body for lighting the water fountain.

24. The laminar water fountain device as claimed in claim 16, comprising at least two water inlet ports.

25. The laminar water fountain device as claimed in claim 16, wherein the jet body is at least partially adjustable in the housing such that the angle of the water fountain emanating from the water fountain device is adjustable.

26. The laminar water fountain device as claimed in claim 25, wherein the jet body further comprises at least one connection structure on the outer surface of the side wall of the jet body, wherein the at least one connection structure cooperates with the at least one jet body support for suspending the jet body within the housing, and wherein the jet body is adjustable relative to the at least one jet body support for adjusting the angle of the water fountain emanating from the water fountain device.

27. The laminar water fountain device as claimed in claim 25, further comprising at least one flexible tube for connecting the water inlet of the housing to the at least one water inlet port of the jet body.

28. The laminar water fountain device as claimed in claim 16, wherein the jet body further comprises at least two water inlet ports, wherein the housing further comprises at least two water inlets, and further comprising at least two flexible tubes for connecting the at least two water inlets of the housing to the at least two water inlet ports of the jet body.

29. The laminar water fountain device as claimed in claim 16, wherein the jet body further comprises at least two water inlet ports, wherein the housing further comprises a splitter for splitting the flow of water through the at least one water inlet into at least two water flows, and further comprising at least two flexible tubes for connecting the at least two water flows to the at least two water inlet ports of the jet body.

* * * * *